US008351826B2

(12) United States Patent
Mohri

(10) Patent No.: US 8,351,826 B2
(45) Date of Patent: Jan. 8, 2013

(54) IMAGE FORMING METHOD, IMAGE FORMING DEVICE, AND IMAGE FORMING PROGRAM

(75) Inventor: Kazuo Mohri, Hyogo (JP)

(73) Assignees: Ricoh Company, Ltd., Tokyo (JP); Ricoh Printing Systems, Ltd., Tokyo (JP)

( * ) Notice: Subject to any disclaimer, the term of this patent is extended or adjusted under 35 U.S.C. 154(b) by 1096 days.

(21) Appl. No.: 11/700,810

(22) Filed: Jan. 30, 2007

(65) Prior Publication Data

US 2007/0189791 A1 Aug. 16, 2007

(30) Foreign Application Priority Data

Feb. 15, 2006 (JP) ..... 2006-038552

(51) Int. Cl.
*G03G 15/04* (2006.01)
*G03G 15/22* (2006.01)

(52) U.S. Cl. ..... 399/235; 399/55; 399/285; 399/222; 399/234; 399/53

(58) Field of Classification Search ..... 399/235, 399/222, 234, 285, 53, 55; 347/240
See application file for complete search history.

(56) References Cited

U.S. PATENT DOCUMENTS

| | | | | |
|---|---|---|---|---|
| 5,857,132 | A * | 1/1999 | Mizuishi et al. | 399/66 |
| 5,970,279 | A * | 10/1999 | Sakaizawa et al. | 399/46 |
| 6,473,574 | B1 * | 10/2002 | Usui et al. | 399/66 |
| 2006/0197825 | A1 | 9/2006 | Mohri | |

FOREIGN PATENT DOCUMENTS

| | | |
|---|---|---|
| JP | 4-218014 | 8/1992 |
| JP | 4-242766 | 8/1992 |
| JP | 9-6151 | 1/1997 |
| JP | 2640760 | 5/1997 |
| JP | 2002-207373 | 7/2002 |
| JP | 2002-283616 | 10/2002 |
| JP | 2003-326760 | 11/2003 |

OTHER PUBLICATIONS

Jan. 11, 2011 Japanese official action in connection with a counterpart Japanese patent application.

Apr. 5, 2011 Japanese official action in connection with a counterpart Japanese patent application.

* cited by examiner

*Primary Examiner* — David Porta
*Assistant Examiner* — Yara Green
(74) *Attorney, Agent, or Firm* — Cooper & Dunham LLP

(57) ABSTRACT

An image forming method, includes a charging step of charging an image carrier; an image writing step of writing image data onto the image carrier; a developing step of developing a latent image area written by the image writing step on the image carrier; a transferring step of transferring a toner image developed by the developing step to a transferring member; an image writing position adjusting step of detecting a position of the image carrier where the image is written in a case where designated conditions are satisfied, and of adjusting an image writing position; and a voltage output control step of controlling voltages applied for charging, developing, and transferring in the charging step, the developing step, and the transferring step, respectively.

14 Claims, 10 Drawing Sheets

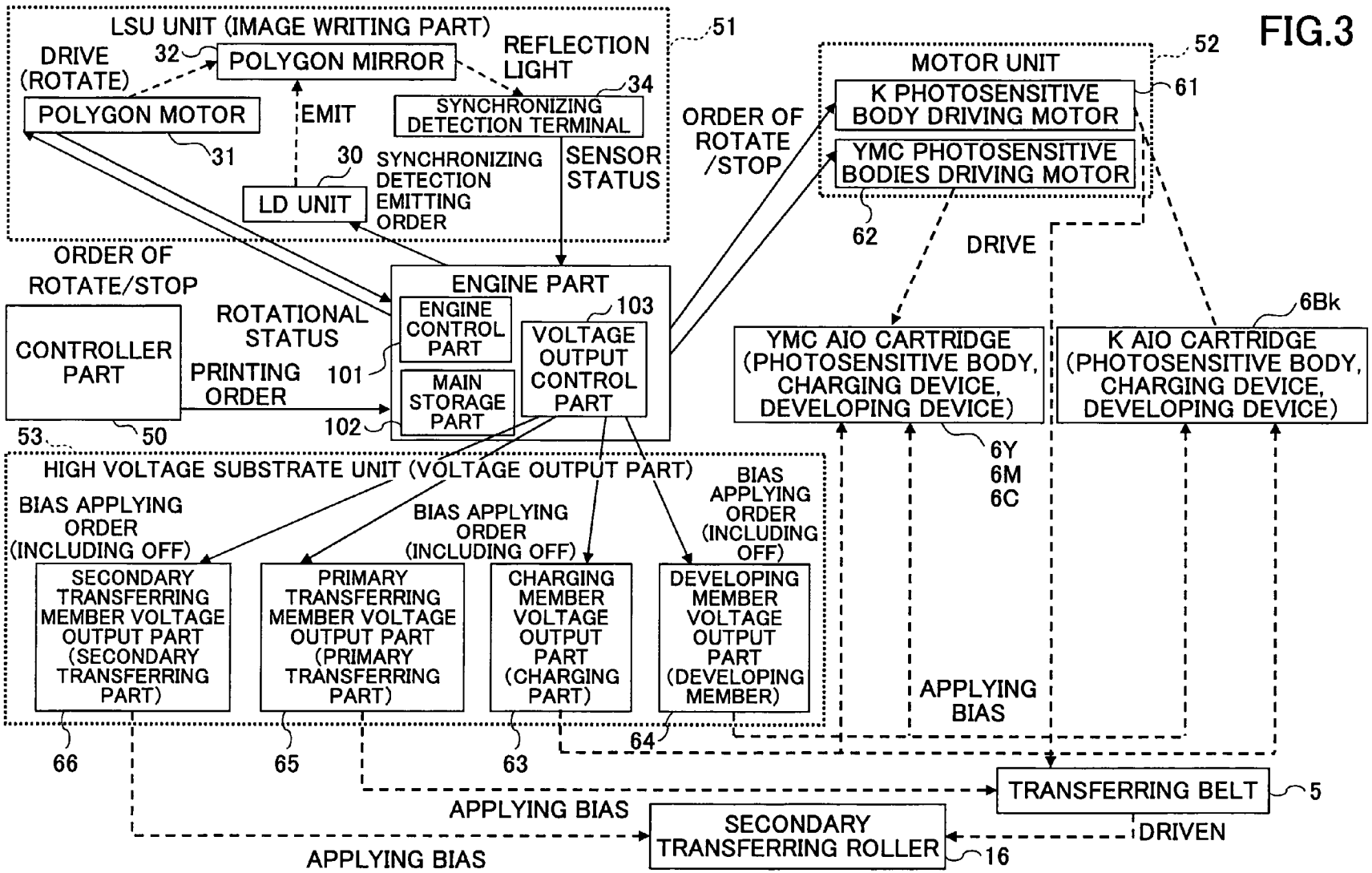
FIG.3
MOTOR UNIT
52
61
K PHOTOSENSITIVE BODY DRIVING MOTOR
YMC PHOTOSENSITIVE BODIES DRIVING MOTOR
62
DRIVE
K AIO CARTRIDGE (PHOTOSENSITIVE BODY, CHARGING DEVICE, DEVELOPING DEVICE)
6Bk
YMC AIO CARTRIDGE (PHOTOSENSITIVE BODY, CHARGING DEVICE, DEVELOPING DEVICE)
6Y
6M
6C
APPLYING BIAS
TRANSFERRING BELT
5
DRIVEN
SECONDARY TRANSFERRING ROLLER
16
ORDER OF ROTATE /STOP
51
LSU UNIT (IMAGE WRITING PART)
REFLECTION LIGHT
34
SYNCHRONIZING DETECTION TERMINAL
SENSOR STATUS
POLYGON MIRROR
32
EMIT
30
LD UNIT
SYNCHRONIZING DETECTION EMITTING ORDER
DRIVE (ROTATE)
POLYGON MOTOR
31
ENGINE PART
103
VOLTAGE OUTPUT CONTROL PART
ENGINE CONTROL PART
101
MAIN STORAGE PART
102
ROTATIONAL STATUS
PRINTING ORDER
ORDER OF ROTATE/STOP
CONTROLLER PART
50
53
HIGH VOLTAGE SUBSTRATE UNIT (VOLTAGE OUTPUT PART)
BIAS APPLYING ORDER (INCLUDING OFF)
DEVELOPING MEMBER VOLTAGE OUTPUT PART (DEVELOPING MEMBER)
64
CHARGING MEMBER VOLTAGE OUTPUT PART (CHARGING PART)
63
PRIMARY TRANSFERRING MEMBER VOLTAGE OUTPUT PART (PRIMARY TRANSFERRING PART)
65
SECONDARY TRANSFERRING MEMBER VOLTAGE OUTPUT PART (SECONDARY TRANSFERRING PART)
66
APPLYING BIAS
APPLYING BIAS

IMAGE FORMING METHOD, IMAGE FORMING DEVICE, AND IMAGE FORMING PROGRAM

BACKGROUND

1. Technical Field

This disclosure generally relates to image forming methods, image forming devices, and image forming programs, and more specifically, to an image forming method of detecting an image writing position, synchronizing, and adjusting the image writing position in order to adjust the image writing position to a transferring material, an image forming device, and an image forming program.

2. Description of the Related Art

Presently, in an image forming device such as a PPC (Plain Paper Copier), based on a printing mode such as a sheet size, sheet kind, or a color mode (color or monochrome) selected by the user or the state of an image forming part, various processes are implemented inside the image forming device so that proper printing quality or printing properties are realized.

For example, adjustment of printing starting position is one of various processes.

Here, an image forming method of the image forming device and the adjusting method of the printing starting position are discussed.

In the image forming method, a laser beam generated by a visible semiconductor laser of an LD (Laser Diode) is rotationally scanned by a polygon mirror. The polygon mirror is a rotating member having four through six plane reflection surfaces. While the polygon mirror is rotated at high speed at several ten thousand rotations per minute, an image is formed. The rotation of the polygon mirror is controlled by a driving motor at a constant speed.

The beam is irradiated on a photosensitive body via a fθ lens so that an image is formed. More specifically, the fθ lens collects the beam deflected by a scanner such as the polygon mirror on a plane image surface for scanning.

Thus, since an irradiation starting position on a main scanning line on the photosensitive body, namely the printing starting position, is determined by the rotational position of the polygon mirror, the rotational position of the polygon mirror should always be known in order to maintain the printing quality.

Because of this, when the rotation of the polygon mirror becomes stable, the semiconductor laser is turned on so that a light path is fixed by the polygon mirror. A proper position is detected by a detection element provided at an end part in the main scanning direction on the irradiated photosensitive body so that synchronization for determining the rotational position of the polygon mirror is detected.

By the above-mentioned method, the manufacturer adjusts a proper printing starting position and maintains printing quality for the user.

However, since the light beam emitted by the semiconductor laser reaches the photosensitive body, exposure of the photosensitive body occurs by adjustment of the image writing position so that a latent image is formed and toner is applied. As a result of this, a toner is adhered on a transferring belt.

In a case where printing is implemented after the printing starting position is adjusted, the toner adhered on the transferring belt can make the rear surface of a fed sheet dirty so that the printing quality is degraded Because of this, in order to solve such a problem, a method for separating the photosensitive body from the transferring member or a method for making the voltage output to the transferring member low has been suggested. See Japanese Laid-Open Patent Application Publication No. 9-6151 and Japanese Patent No. 2640760.

However, as discussed in Japanese Laid-Open Patent Application Publication No. 9-6151, in the method for separating the photosensitive body from the transferring member, it is difficult to form a structure where the photosensitive body is separated. Therefore, this causes a large size of the product and increase of cost of the product. Furthermore, the printing property (printing speed) such as fast printing is decreased.

In addition, as discussed in Japanese Patent No. 2640760, in the method for making the voltage output applied to the transferring member low when a latent-imaged area reaches the transferring position of the transferring member so that transferring from the photosensitive body is prevented, the toner is actually adhered on the photosensitive body. Therefore, if the photosensitive body and the transferring member are not separated, a slight amount of the toner may be adhered due to friction.

SUMMARY

In an aspect of this disclosure, there are provided an image forming method, image forming device, and image forming program whereby rear surface dirt formed due to image writing position adjustment can be prevented.

In another aspect of this disclosure, there is provided an image forming method, including a charging step of charging an image carrier; an image writing step of writing image data onto the image carrier; a developing step of developing a latent image area written by the image writing step on the image carrier; a transferring step of transferring a toner image developed by the developing step to a transferring member, an image writing position adjusting step of detecting a position of the image carrier where the image is written in a case where designated conditions are satisfied, and of adjusting an image writing position; and a voltage output control step of controlling voltages applied for charging, developing, and transferring in the charging step, the developing step, and the transferring step, respectively; wherein, in a case where the image writing position adjusting step is implemented, outputs of the voltages are controlled in advance by the voltage output control step so that at least two of charging, developing, and transferring are not implemented in the charging step, the developing step, and the transferring step, respectively.

In another aspect, there is provided an image forming device, including: a charging part configured to charge an image carrier; an image writing part configured to write image data onto the image carrier; a developing part configured to develop a latent image area written by the image writing part onto the image carrier; a transferring part configured to transfer a toner image developed by the developing part to a transferring member; an image writing position adjusting part configured to detect a position of the image carrier where the image is written in a case where designated conditions are satisfied, and configured to adjust an image writing position; and a voltage output control part configured to control voltages applied to the charging part, the developing part, and the transferring part; wherein, in a case where the image writing position adjusting part is implemented, outputs of the voltages are controlled in advance by the voltage output control part so that at least two of charging, developing, and transferring are not implemented in the charging part, the developing part, and the transferring part, respectively.

In another aspect, there is provided an image forming program making computer implement steps, the steps including:

a charging step of charging an image carrier; an image writing step of writing image data onto the image carrier; a developing step of developing a latent image area written by the image writing step on the image carrier; a transferring step of transferring a toner image developed by the developing step to a transferring member; an image writing position adjusting step of detecting a position of the image carrier where the image is written in a case where designated conditions are satisfied, and of adjusting an image writing position; and a voltage output control step of controlling voltages applied for charging, developing, and transferring in the charging step, the developing step, and the transferring step, respectively; wherein, in a case where the image writing position adjusting step is implemented, outputs of the voltages are controlled in advance by the voltage output control step so that at least two of charging, developing, and transferring are not implemented in the charging step, the developing step, and the transferring step, respectively.

In above-mentioned image forming method, image forming device, and image forming program, it is possible to prevent forming the rear surface dirt due to image writing position adjustment.

Other aspects, features, and advantages will become more apparent from the following detailed description when read in conjunction with the accompanying drawings.

BRIEF DESCRIPTION OF THE DRAWINGS

FIG. 3 is a block diagram of a part of the functional structure of the image forming device of first and second embodiments of the present invention;

DETAILED DESCRIPTION OF THE PREFERRED EMBODIMENTS

A description is given below, with reference to the FIG. 1 through FIG. 10 of embodiments of the present invention.

First Embodiment of the Present Invention

Figure 1:
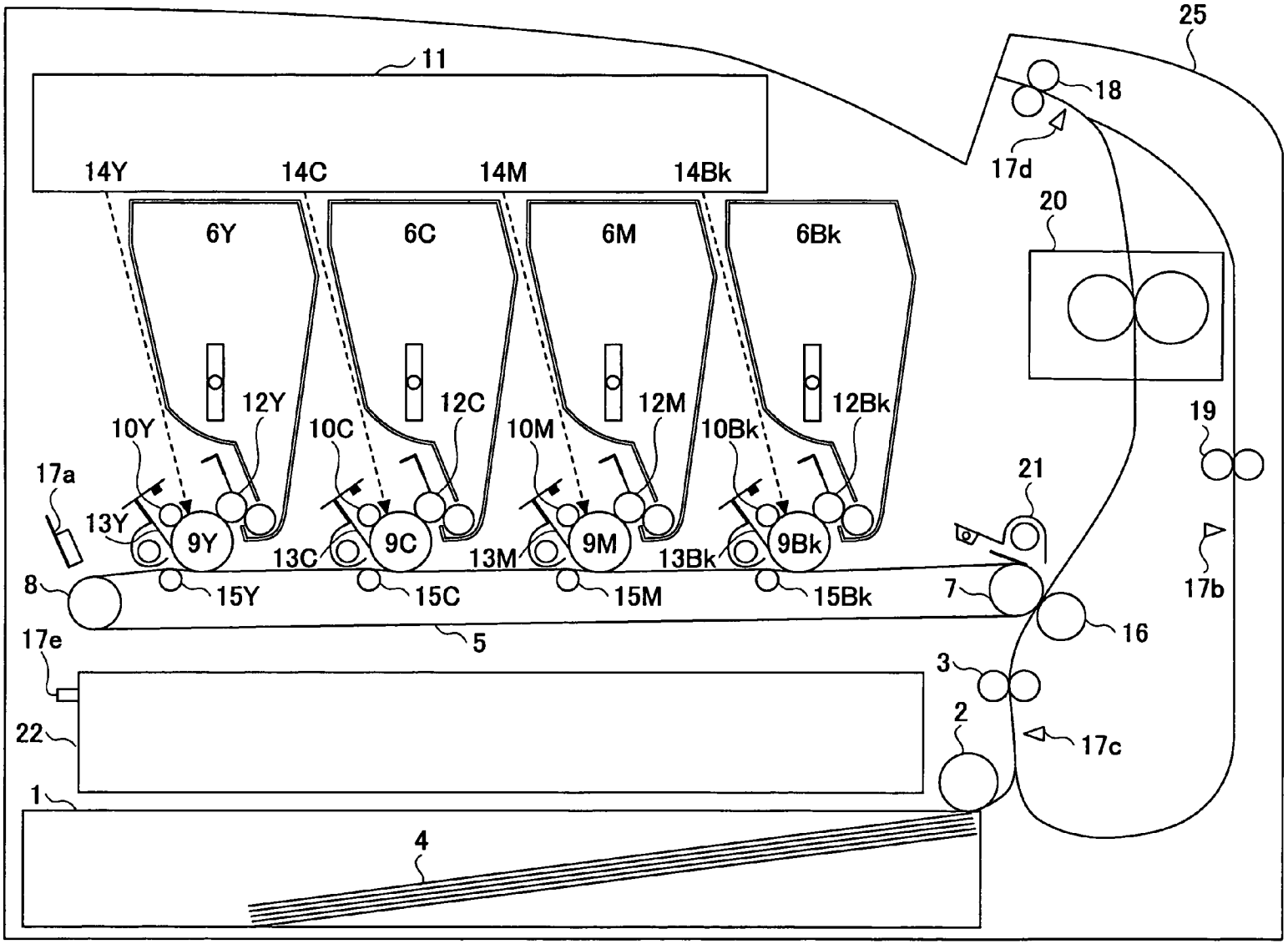
FIG. 1 is a cut-away view showing the hardware structure of an image forming device of first and second embodiments of the present invention.

FIG. 1 is a cut-away view showing the hardware structure of an image forming device 25 of first and second embodiments of the present invention.

As shown in FIG. 1, the image forming device 25 of first and second embodiments of the present invention includes a main body sheet feeding tray 1, a sheet feeding roller 2, resist rollers 3, a transferring belt 5, AIO (All In One) cartridges 6Y (Y: Yellow), 6C (C: Cyan), 6M (M: Magenta), and 6Bk (Bk: Black), a secondary transferring driving roller 7, a transferring belt tension roller 8, photosensitive bodies 9Y, 9C, 9M, and 9Bk, charging rollers 10Y, 10C, 10M, and 10Bk, an exposure device 11, developing devices 12Y, 12C, 12M, and 12Bk, cleaner blades 13Y, 13C, 13M, and 13Bk, semiconductor lasers 14Y, 14C, 14M, and 14Bk, primary transferring rollers 15Y, 15C, 15M, and 15Bk, a secondary transferring roller 16, a TM (Timer) sensor 17*a*, a both surfaces sensor 17*b*, a resist sensor 17*c*, a sheet discharge sensor 17*d*, a waste toner full detection sensor 17*e*, sheet discharge rollers 18 and 19, a fixing device 20, an intermediate belt cleaner 21, and a waste toner box 22. Sheets 4 are stored in the main body sheet feeding tray 1.

In the image forming device 25, for yellow (Y), cyan (C), magenta (M), and Black (Bk), a line of the semiconductor lasers 14Y, 14C, 14M, and 14Bk that are light sources for image writing (exposing) and a line of the photosensitive bodies 9Y, 9C, 9M, and 9Bk for carrying latent images are provided. A line of the developing devices 12Y, 12C, 12M, and 12Bl is provided in parallel. In other words, the image forming device 25 is a tandem type image forming device.

In addition, in the image forming device 25, an intermediate transferring type is realized by the transferring belt 5 and the secondary transferring roller 16 so that the size of the image forming device 25 is made small. Here, parts forming the hardware of the image forming device 25 shown in FIG. 1 are discussed.

The sheets 4 that are transferring members such as copying sheets or OHP are stored in the main body sheet feeding tray 1.

At the time of printing, the sheet feeding roller 2 as a rotational driving roller having a rotational driving motor is rotated counterclockwise so that the sheet 4 situated at the top of the sheets 4 stored in the main body sheet feeding tray 1 is fed by friction of the roller 2 and the sheet is sent out to a sheet carriage path.

The resist rollers 3 are among the carriage supplemental rollers on the sheet carriage path. The resist rollers 3 are rotational driving rollers and carry the sheet 4 sent by the sheet feeding roller 2 to the transferring rollers without sheet jamming on the sheet carriage path.

The transferring belt 5 is called an intermediate transferring belt. The transferring belt 5 is a ring shaped belt and wound at the secondary transferring driving roller 7 and the transferring belt tension roller 8. The transferring belt 5 is rotationally driven by the secondary transferring driving roller 7 so that a developed image is transferred onto the sheet 4.

In addition, the secondary transferring driving roller 7 is a rotationally driving roller for rotationally driving the transferring belt 5.

Furthermore, the transferring belt tension roller 8 is a rotationally driven supplemental roller for rotationally moving the transferring belt 5.

The AIO cartridges 6Y, 6C, 6M, and 6Bk called electrophotographic process parts implement image forming. Each of the AIO cartridges 6Y, 6C, 6M, and 6Bk is independently provided in the image forming device 25. The AIO cartridges 6Y, 6C, 6M, and 6Bk include the photosensitive bodies 9Y, 9C, 9M, and 9Bk, the charging rollers 10Y, 10C, 10M, and 10Bk, the developing devices 12Y, 12C, 12M, and 12Bk, and the cleaner blades 13Y, 13C, 13M, and 13Bk, respectively.

Each of the photosensitive bodies 9Y, 9C, 9M, and 9Bk is independently provided in the image forming device 25 and carries an image formed by an electrostatic latent image, namely by latent image forming.

The charging rollers 10Y, 10C, 10M, and 10Bk are provided in the periphery of each of the photosensitive bodies 9Y, 9C, 9M, and 9Bk, respectively. By applying a negative polarity voltage, an electronic charge having a negative polarity that is a standard polarity of toner is applied on an each surface of the photosensitive bodies 9Y, 9C, 9M, and 9Bk.

Each of the developing devices 12Y, 12C, 12M, and 12Bk is independently provided in the image forming device 25. By applying negative polarity voltages, the colors of nonmagnetic toners stored in the AIO cartridges 6Y, 6C, 6M, and 6Bk are electrostatically contacted, namely adhered, on the surface of the photosensitive bodies 9Y, 9C, 9M, and 9Bk, respectively, via supplying rollers. As a result of this, a formed latent image is developed so that a toner image of each of the colors is formed.

Each of the cleaner blades 13Y, 13C, 13M, and 13Bk is independently provided in the image forming device 25. In a case where the toner images formed on the photosensitive bodies 9Y, 9C, 9M, and 9Bk are transferred on the surface of the transferring belt 5, unnecessary nonmagnetic toners remaining on the surfaces of the photosensitive bodies 9Y, 9C, 9M, and 9Bk are removed by the cleaner blades 13Y, 13C, 13M, and 13Bk, respectively.

The exposure device 11 called an image writing part exposes, namely writes images on the surfaces of the photosensitive bodies 9Y, 9C, 9M, and 9Bk. The exposure device 11 has semiconductor lasers 14Y, 14C, 14M, and 14Bk situated independently for corresponding colors.

The semiconductor lasers 14Y, 14C, 14M, and 14Bk emit laser lights and latent images are formed by irradiating the laser lights onto the surfaces of the photosensitive bodies 9Y, 9C, 9M, and 9Bk, respectively.

The primary transferring rollers 15Y, 15C, 15M, and 15Bk are rotationally driving rollers for transferring the toner images formed on the surfaces of the photosensitive bodies 9Y, 9C, 9M, and 9Bk to the surface of the transferring belt 5 by the photosensitive bodies 9Y, 9C, 9M, and 9Bk contacting the transferring belt 5 and applying a positive polarity voltage.

The primary transferring rollers 15Y, 15C, 15M, and 15Bk also have functions for separating the photosensitive bodies 9Y, 9C, 9M, and 9Bk from the transferring belt 5. In a case of monochrome (black and white) printing, only the primary transferring roller 15Bk corresponding to black makes the photosensitive body 9Bk come in contact with the transferring belt 5. Other primary transferring rollers 15Y, 15C, and 15M corresponding to Y, C, and M are separated and are in waiting states.

The secondary transferring roller 16 comes in contact with the transferring belt 5. The secondary transferring roller 16 is a rotationally driving roller where a positive polarity voltage is applied so that the toner image transferred onto the surface of the transferring belt 5 passes along the sheet carriage path and is transferred onto the surface of the conveyed sheet 4.

The TM (Timer) sensor 17*a*, the both surfaces sensor 17*b*, the resist sensor 17*c*, the sheet discharge sensor 17*d*, and the waste toner full detection sensor 17*e* know to which position the sheet 4 fed in the image forming device 25 is carried at the time of printing job implementation.

The sensor 17*e* determines whether an amount of collected unnecessary toners, namely waste toners, exceeds the allowable amount that can be stored by the image forming device 25 accompanying collection of unnecessary discharged nonmagnetic toners.

The sheet discharge rollers 18 and 19 are rotationally driving rollers having a rotationally driving motor for carrying the sheet 4 to a paper discharging part so that the printed sheet 4 is discharged to outside the image forming device 25 after the toner image transferred to the sheet 4 is fixed.

The fixing device 20 fixes the toner image passing between the transferring belt 5 and the secondary transferring roller 16 and transferred onto the surface of the sheet 4 by heat and pressure.

The intermediate belt cleaner 21 removes unnecessary nonmagnetic toners remaining on the surface of the transferring belt 5 in a case where the toner image on the surface of the transferring belt 5 is transferred onto the sheet 4.

The waste toner box 22 stores the waste toners removed by the intermediate belt cleaner 21 or the cleaner blade 13Y, 13C, 13M, and 13Bk of the AIO cartridges 6Y, 6C, 6M, and 6Bk.

The following explanation is made by using the image forming device 25 shown in FIG. 1.

Figure 2:
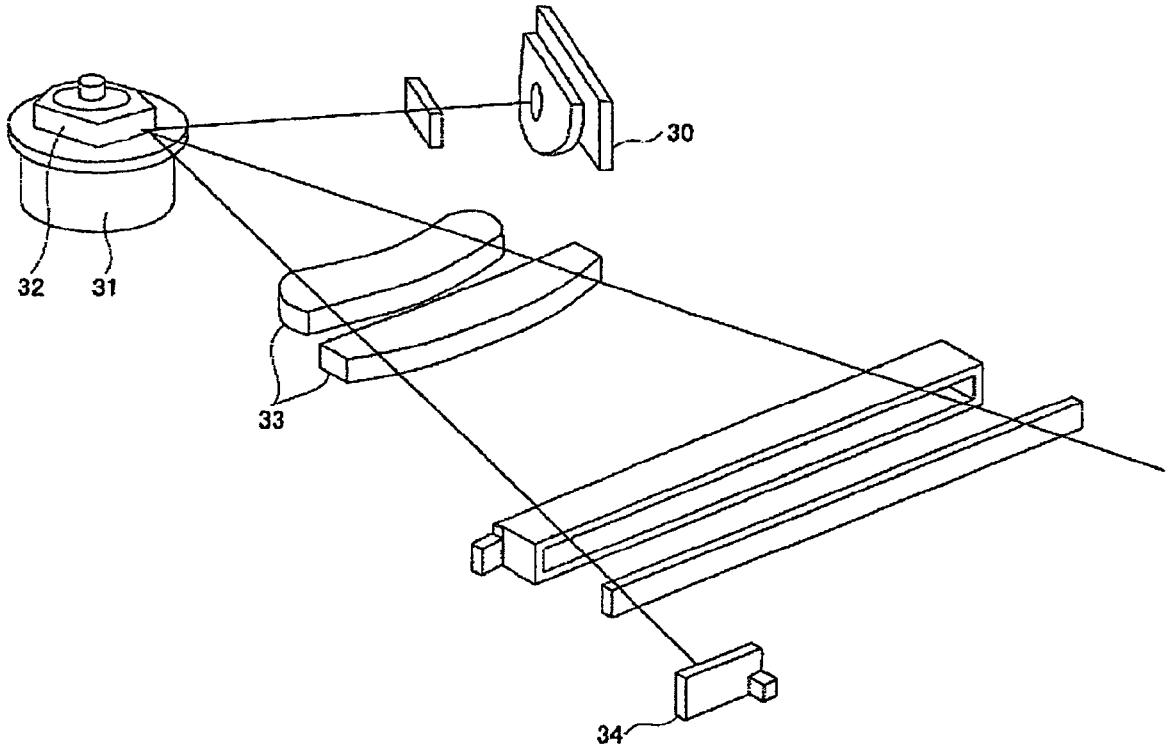
FIG. 2 is a perspective view showing the structure of an exposure device of the first and second embodiments of the present invention.

FIG. 2 is a view showing the structure of an exposure device 11 of the first and second embodiments of the present invention.

The exposure device 11 of the image forming device 25 shown in FIG. 1 irradiates laser light onto the surfaces of the photosensitive bodies 9Y, 9C, 9M, and 9Bl by using the semiconductor lasers 14Y, 14C, 14M, and 14Bk so that corresponding images are written (exposure is made).

A LD (Laser Diode) unit 30 has the semiconductor lasers 14Y, 14C, 14M, and 14Bk which are visible semiconductor lasers and is a light source emitting the laser light.

A polygon motor 31 is a rotational driving motor for rotationally driving a member reflecting the laser light irradiated from the LD unit 30 at a constant speed.

A polygon mirror 32 is a rotating member having four through six plane reflection surfaces. While the polygon mirror 32 is rotated at high speed at several ten thousand rotations per minute by the polygon motor 31, the polygon mirror 32 is scanned.

A fθ lens 33 collects the laser light deflected by the polygon mirror 32 on a plane image surface.

An image writing detection element 34 detects a position where an image is written so that the image forming device 25 adjusts the image writing positions of the surfaces of the photosensitive bodies 9Y, 9C, 9M, and 9Bk. The image writing detection elements 34 are provided at end parts in a main scanning direction of the photosensitive bodies 9Y, 9C, 9M, and 9Bk.

Next, a method is discussed where each of the parts shown in FIG. 2 writes (exposes) an image onto the surfaces of the photosensitive bodies 9Y, 9C, 9M, and 9Bk.

The laser light emitted from the LD unit 30 is rotationally scanned by the polygon mirror 32 rotationally controlled at the constant speed by the polygon motor 31. A light path of the laser light is bent (deflected) by a mirror via the fθ lens 33. The laser light is irradiated onto the surfaces of the photosensitive bodies 9Y, 9C, 9M, and 9Bk so that images are written.

Accordingly, the image writing positions (irradiation position) on the photosensitive bodies 9Y, 9C, 9M, and 9Bk are determined by the rotational position of the polygon mirror 32. Hence, it is necessary to always know the rotational position of the polygon mirror 32 so that the image forming device 25 can maintain the printing quality.

Because of this, in order to know the rotational position of the polygon mirror 32 after receipt of the printing order from the user before the start of printing, by the above-discussed image writing method, a single line image is written on each of the surfaces of the photosensitive bodies 9Y, 9C, 9M, and 9Bk in the main scanning direction. By the image writing detection element 34 situated on the line, the image writing position is detected and the writing position is adjusted.

Here, the adjustment of the image writing position is called synchronizing detection.

Next, a flow is discussed where the image forming device 25 forms the image after the image writing position is adjusted, the image is printed on the sheet 4, and then the sheet 4 is discharged.

After receiving the printing order from the user, the image writing device 25 applies a negative electric charge on the surfaces of the photosensitive bodies 9Y, 9C, 9M, and 9Bk by the charging rollers 10Y, 10C, 10M, and 10Bk.

Next, the laser light is irradiated on the surfaces of the photosensitive bodies 9Y, 9C, 9M, and 9Bk from the LD unit 30 corresponding to the colors Y, C, M, and Bk provided in the exposing device 11.

In the surfaces of the photosensitive bodies 9Y, 9C, 9M, and 9Bk equally charged by negative electric charges by the charging rollers 10Y, 10C, 10M, and 10Bk, the negative electric charges in only the irradiated area are reduced. The latent images corresponding to each of the colors Y, C, M and Bk are formed on the surfaces of the photosensitive bodies 9Y, 9C, 9M, and 9Bk.

Next, non-magnetic toners in the AIO cartridges 6Y, 6C, 6M and 6Bk are adhered on the surfaces of the photosensitive bodies 9Y, 9C, 9M, and 9Bk where the latent images are formed by the developing devices 12Y, 12C, 12M, and 12Bk provided in the AIO cartridges 6Y, 6C, 6M and 6Bk so that the latent images formed on the surfaces of the photosensitive bodies 9Y, 9C, 9M, and 9Bk are developed and thereby toner images are formed.

At this time, after the latent images formed on the surfaces of the photosensitive bodies 9Y, 9C, 9M, and 9Bk are developed, a Y toner image, a C toner image, an M toner image, and a K toner image are formed.

Next, the non-magnetic toners adhered on the photosensitive bodies 9Y, 9C, 9M, and 9Bk are transferred to the transferring belt 5 coming in contact with the photosensitive bodies 9Y, 9C, 9M, and 9Bk in the order of Bk, M, C, and Y so that the toner images of four colors, independently formed for each of colors of Y, C, M, and Bk, are overlapped (superposed) on the transferring belt 5.

Last, the sheet 4 situated at the top of the sheets 4 stored in the main body sheet feeding tray 1 is fed by the sheet feeding roller 2 and is sent out to a sheet carriage path. The sheet 4 passes through between the transferring belt 5 and the secondary transferring roller 16 coming in contact with the transferring belt 5 via the resist rollers 3. The unified (superposed) four color toner image on the surface of the transferring belt 5 is transferred to the sheet 4 and then the transferred toner image is fixed to the sheet 4 by heat and the pressure applied by the fixing device 20 shown in FIG. 1. After that, the sheet 4 is discharged outside the image forming device 25.

As discussed above, on the surfaces of the photosensitive bodies 9Y, 9C, 9M, and 9Bk where the image writing position is adjusted, the single line image for image writing position adjustment is written and the latent image is formed. Therefore, the toner is applied onto the photosensitive bodies 9Y, 9C, 9M, and 9Bk by the developing devices 12Y, 12C, 12M, and 12Bk and is transferred onto the surface of the transferring member (the transferring belt 5, the secondary transferring roller 16). In a case where printing is performed after adjustment, the fed sheet 4 can be made dirty due to the toner adhering to the transferring member.

FIG. 3 is a block diagram of a part of the functional structure of the image forming device 25 of first and second embodiments of the present invention.

The image forming device 25 includes a control part 50, an LSU (Laser Scan Unit) 51, a high voltage substrate unit 53, the transferring belt 5, the secondary transferring roller 16, the AIO cartridges 6Y, 6C, 6M, and 6Bk, and an engine part 100.

The control part 50 includes a CPU (Central Processing Unit) and an ASIC (Application Specific Integrated Circuit). The control part 50 implements a program for realizing functions (copier, printer, FAX, or the like) of the image forming device 25. The control part 50 controls operations of the image forming device 25 via a system bus.

In addition, the control part 50 implements printing preparation (image processing by the application) based on the printing order from the user so as to direct the image forming control part 100 to print.

The LSU unit 51 has the polygon motor 31, the polygon mirror 32, the LD unit 30, and the image writing detection element 34.

The polygon mirror 32 is rotated at constant speed by the polygon motor 31 and the laser light emitted from the LD unit 30 is irradiated on the surfaces of the photosensitive bodies 9Y, 9C, 9M, and 9Bk so that the latent images are formed.

The motor unit 52 includes a Bk photosensitive driving motor 61 and a YCM photosensitive driving motor 62 so as to rotationally drive the photosensitive bodies 9Y, 9C, 9M, and 9Bk.

The Bk photosensitive driving motor 61 rotationally drives the photosensitive body 9Bk and the YCM photosensitive driving motor 62 rotationally drives the photosensitive bodies 9Y, 9C, and 9M.

The reason why the Bk photosensitive driving motor 61 and the YCM photosensitive driving motor 62 are provided is to rotationally drive the appropriate photosensitive bodies, depending on the color mode of monochrome (black and white) printing or color printing.

The high voltage substrate unit 53 includes a charging member voltage output part 63, a developing member voltage output part 64, a primary transferring member voltage output part 65, and a secondary transferring member voltage output part 66. When image forming is being conducted by the image forming device 25, the high voltage substrate unit 53 applies a voltage for image forming to the charging rollers 10Y, 10C, 10M, and 10Bk of the AIO cartridges 6Y, 6C, 6M, and 6Bk, the developing devices 12Y, 12C, 12M, and 12Bk, the transferring belt 5, and the secondary transferring roller 16.

A CPU (Central Processing Unit) is provided in an engine control part 101 of the engine part 100. The engine part 100 implements a program for realizing image forming functions of the image forming device 25. The engine part 100, via an I/O input and output circuit, controls driving parts for driving a sheet conveying part, an image forming part and a sheet discharging part. The sheet conveying part takes out the printing sheet stored in the sheet feeding cassette where various sizes of the printing sheets are stored and conveys the printing sheet to the image forming part. The image forming part forms the image from the printing information and prints on the printing sheet. Upon completing of printing, the printing sheet is discharged to the sheet discharging tray by the sheet discharging part.

A ROM (Read Only Memory) and a RAM (Random Access Memory) are provided in a main storage part 102 of the engine part 100. A control program implemented by the engine control part 101 is stored in the ROM. At the time of executing the program, the program stored in the ROM is loaded in the RAM for a while. Data used for the program, data at the time of image forming, and the count of a timer counter are held in the RAM for a while.

The engine part 100 includes a voltage output control part 103. The voltage output control part 103 controls voltages applied by the charging member voltage output part 63, the developing member voltage output part 64, the primary transferring member voltage output part 65, and the secondary transferring voltage output part 66.

By executing the control program stored in the ROM, the engine control part 101 receives the printing order signal from the control part 50 and controls the LSU unit 51 and the motor unit 52. In addition, the engine control part 10I controls devices in the high voltage substrate unit 53 via the voltage output control part 103 so as to determine the necessity of image writing position adjustment. Thus, after adjustment of the image writing position, rear surface dirt is prevented from being printed.

Next, control by the engine control part 101 is discussed.

First, the engine control part 101 determines whether the image writing position adjustment is necessary. In order to implement the image writing of the image writing position adjustment, the engine control part 101 sends a rotation order to the polygon motor 31 of the LSU unit 51.

The polygon motor 31, based on the order, rotates the polygon mirror 32 at constant speed so as to return a signal indicating the rotational status to the engine control part 101.

The engine control part 101 detects the rotational state from a rotational status signal ("Hi level", "Lo Level") sent from the polygon motor 31.

Next, the engine control part 101 sends an emitting order for the image writing position adjustment to the LD unit 30. The laser light is irradiated from the LD unit 30 so that a single line image for image writing position adjustment is written on the surfaces of the photosensitive bodies 9Y, 9C, 9M, and 9Bk and thereby latent images are formed.

At this time, the laser light enters the image writing detection element 34 and the status is reported to the engine control part 101.

Next, the engine control part 101 sends rotation order to the K photosensitive body driving motor 61 and the YCM photosensitive bodies driving motor 62 of the motor unit 52.

Receiving the orders, the K photosensitive body driving motor 61 and the YCM photosensitive bodies driving motor 62 of the motor unit 52 rotationally drive the photosensitive bodies 9Y, 9C, 9M, and 9Bk.

Driving forces are transferred from the photosensitive body driving motors 61 and 62 to the charging rollers 10Y, 10C, 10M, and 10Bk and the developing devices 12Y, 12C, 12M, and 12Bk of the AIO cartridges 6Y, 6C, 6M, and 6Bk, so that rotational driving is started.

In addition, a driving force is transmitted to the K photosensitive body driving motor 61 by a gear line and the transferring belt 5 starts rotational driving. Finally, the secondary transferring roller 16 comes in contact with the transferring belt 5 and starts rotational driving.

Next, the engine control part 101 sends a bias applying order (may include an order to turn voltage output off) for preventing formation of the rear surface dirt due to image writing position adjustment to the charging member voltage output part 63, the developing member voltage output part 64, the primary transferring member voltage output part 65, and the secondary transferring member voltage output part 66.

The charging member voltage output part 63, receiving the order, applies the voltages to the charging rollers 10Y, 10C, 10M, and 10Bk.

The developing member voltage output part 64, receiving the order, applies the voltages to the developing devices 12Y, 12C, 12M, and 12Bk.

The primary transferring member voltage output part 65, receiving the order, applies the voltage to the transferring belt 5.

The secondary transferring member voltage output part 66, receiving the order, applies the voltage to the secondary transferring roller 16.

Thus, the image forming device 25 controls the voltages applied to the charging rollers 10Y, 10C, 10M, and 10Bk, the developing devices 12Y, 12C, 12M, and 12Bk, the transferring belt 5, and the secondary transferring roller 16 after the image writing position adjustment is implemented so that the toner is prevented from being adhered to the surfaces of the photosensitive body or the transferring member and thereby rear surface dirt is prevented from forming.

Figure 4:
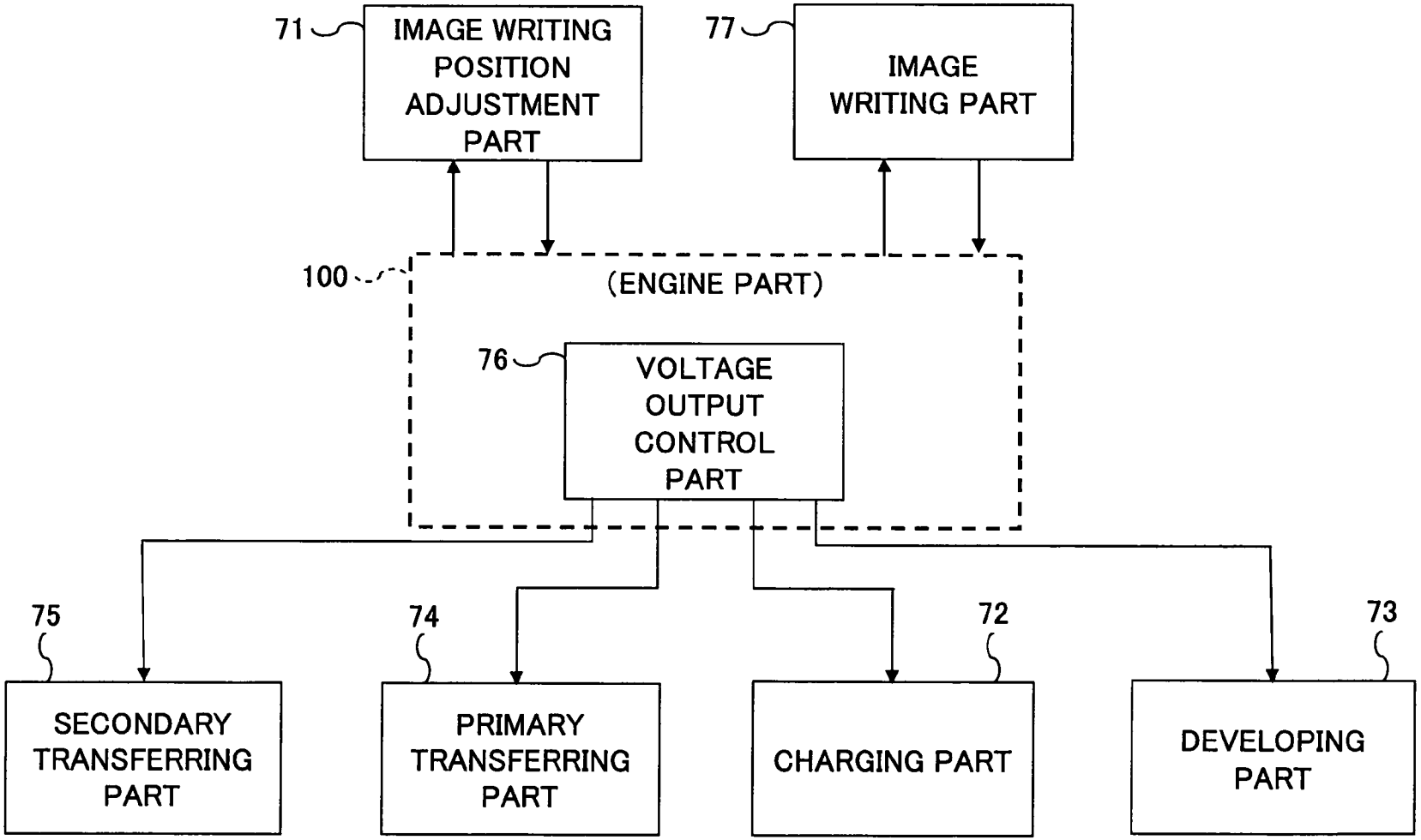
FIG. 4 is a block diagram showing of a main part of the first and second embodiments of the present invention.

FIG. 4 is a block diagram showing a structure of a main part of the first and second embodiments of the present invention. The main part includes an image writing position adjustment part 71, a charging part 72, a developing part 73, a primary transferring part 74, a secondary transferring part 75, a voltage output control part 76, and an image writing part 77.

In the image writing position adjustment part 71, since the rotational position of the polygon mirror 32 is a starting position for writing an image onto the surfaces of the photosensitive bodies 9Y, 9C, 9M, and 9Bk of the image forming device 25, the laser light for image writing is detected by the image writing detection element 34 so that the rotational position of the polygon mirror 32 is always known and the writing position is adjusted.

In other words, after the rotation of the polygon mirror 32 become stable, the laser light is emitted from the LD unit 30. By the irradiated laser light, a single line image is written on the surfaces of the photosensitive bodies 9Y, 9C, 9M, and 9Bk in the main scanning direction. The writing position is detected by the image writing detection element 34 provided at an end part in the main scanning direction of the photosensitive bodies 9Y, 9C, 9M, and 9Bk.

The image writing detection part 71 operates at the time of printing jobs and at the time of change of rotational speed of the polygon motor 31 and the photosensitive body 9Bk due to change of printing mode (sheet size, kinds of sheets, color mode, or the like) during the continuing printing.

In the charging part 72, the voltages are applied to the charging rollers 10Y, 10C, 10M, and 10Bk by the charging member voltage output part 63 of the high voltage substrate unit 53 of the image forming device 25 so that electrical charges having polarities at the time of applying the voltages are charged on the surfaces of the photosensitive bodies 9Y, 9C, 9M, and 9Bk.

The developing part 73 uses an electrostatic force generated by applying the voltages to the developing devices 12Y, 12C, 12M, and 12Bk by the developing member voltage output part 64 of the high voltage substrate unit 53 of the image forming device 25 so that the non-magnetic toners stored in the AIO cartridges 6Y, 6C, 6M, and 6Bk are adhered on the surfaces of the photosensitive bodies 9Y, 9C, 9M, and 9Bk via the supplying roller and thereby the latent images are developed and the toner images of colors Y, C, M, and Bk are formed.

The primary transferring part 74 uses an electrostatic force generated by applying the voltages to the transferring belt 5 by the primary transferring member voltage output 65 of the high voltage substrate unit 53 of the image forming device 25 so that the toner images formed on the surfaces of the photosensitive bodies 9Y, 9C, 9M, and 9Bk are transferred to the transferring belt 5.

The secondary transferring part 75 uses an electrostatic force generated by applying the voltages to the secondary transferring roller 16 by the secondary transferring member voltage output 66 of the high voltage substrate unit 53 of the image forming device 25 so that the toner images transferred on the surface of the transferring belt 5 are transferred to the sheet 4 as a transferring member.

In the engine control part 101 of the engine part 100, the voltage output control part 76 implements the control program and sends bias applying orders to be applied by the charging part 72, the developing part 73, the primary transferring part 74, and the secondary transferring part 75 so that the voltage control is implemented.

In addition, the order of applying bias controls the output voltage by a duty ratio of PWM (Pulse Width Modulation).

Furthermore, the voltage output control part 76 controls the voltages applied to least two of the charging part 72, the developing part 73, and the transferring parts 74 and 75 in order to prevent the rear surface dirt from forming by the image writing detection part 71.

The image writing part 77 forms a latent image by irradiating the laser light emitted from the LD unit 30 onto the surfaces of the photosensitive bodies 9Y, 9C, 9M, and 9Bk.

Thus, in the image forming device 25, the image writing position adjustment is implemented by the image writing position adjusting part 71. The voltages applied to the charging part 72, the developing part 73, the primary transferring part 74 and the secondary transferring part 75 are controlled by the voltage output control part 76 so that the toner is prevented from being adhered on the surface of the photosensitive body or the transferring member and thereby the rear surface dirt is prevented from forming.

Figure 5:
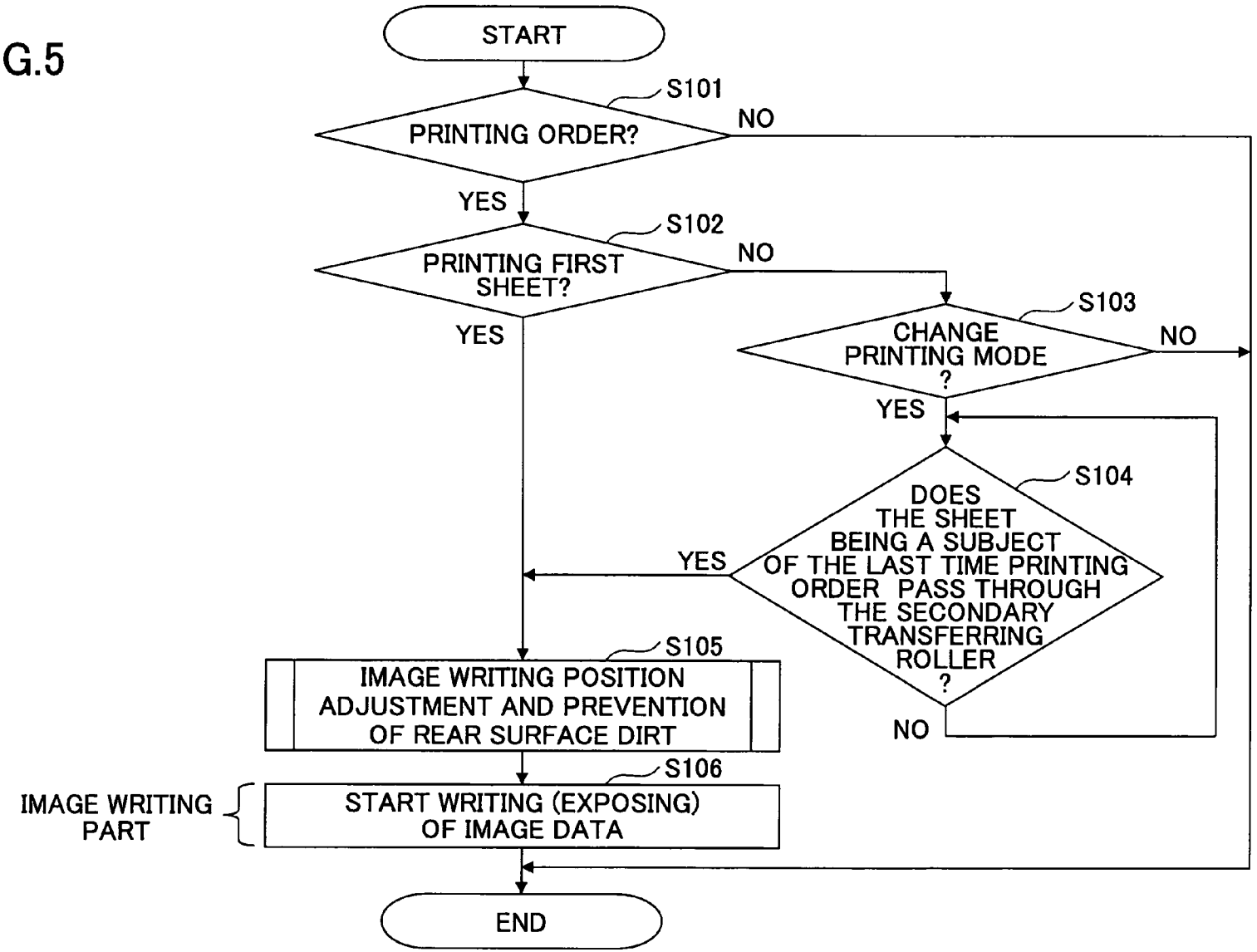
FIG. 5 is a flowchart of processes from start of receipt of printing instruction to image writing of the first and second embodiments of the present invention.

FIG. 5 is a flowchart of processes from start of receipt of printing instruction to image writing of the first and second embodiments of the present invention.

Main processes shown in FIG. 5 include processes of receiving the printing order, determining operation orders of the image writing position adjustment part 71, operations of the image writing position adjustment part 71 and preventing the rear surface dirt from forming, and implementing printing.

The processes shown in FIG. 5 are implemented by the engine control part 101 of the engine part 100 of the image forming device 25.

First, the engine control part 101 determines whether the printing order signal is sent from the control part 50 in S101.

In addition, a signal directing a printing mode is sent from the control part 50 to the engine control part 101 at the same time of sending the printing order signal.

If the printing order signal is not sent from the control part 50 to the engine control part 101 (NO in S101), the engine control part 101 determines that there is no need to implement the image writing position adjusting part 71 and waits for the next printing order signal from the control part 50.

If the printing order signal is sent from the control part 50 to the engine control part 101 (YES in S101), whether it is the printing job starting time that is an operating condition of the image writing position adjusting part 71 is determined from the signal instructing the printing mode by whether the sheet is first one for printing in S102.

If it is the printing job starting time (YES in S102), the engine control part 101 determines that there is need to implement the image writing position adjusting part 71 so that the process for prevention of the rear surface dirt forming including an image writing position adjustment process is implemented in S105. After that, writing printing data required by the user is ordered to the LD unit 30 so that image is written in S106.

If it is not the printing job starting time (NO in S102), whether the printing mode during printing (continuing pages printing) is changed is determined in S103.

If there is no change of the printing mode (NO in S103), the engine control part 101 determines that there is no need to implement the image writing position adjusting part 71 and waits for the next printing order signal from the controller part 50.

If there is a change of the printing mode (YES in S103), the engine control part 101 determines whether a sheet being printed because of order from the controller part 50 before the present received printing order passes by the secondary transferring roller 16 in S104.

Since the AIO cartridge 6Bk, the transferring belt 5, and the secondary transferring roller 16 are driven by the K photosensitive body driving motor 61, it is necessary to switch the operation of image forming at the timing so that there is no influence on the toner image transferred on the sheet. Hence, this determination (S104) is implemented.

If the sheet being printed does not pass by the secondary transferring roller 16 (NO in S104), the engine control part 101 waits until the sheet being printed passes by the secondary transferring roller 16. The engine control part 101 makes a timing when the image writing position adjusting part 71 is operated, between printing pages during printing where the next latent images are not formed on the photosensitive bodies 9Y, 9C, 9M, and 9Bk.

If the sheet being printed passes by the secondary transferring roller 16 (YES in S104), the engine control part 101 determines that there is need to implement the image writing position adjusting part 71 so as to implement a process for preventing the rear surface dirt from forming including the process of the image writing position adjusting part 71 in S105. After that printing the data required by the user is implemented in S106.

By the above-discussed processes, from the start of receipt of the printing order to image writing, the image writing position is adjusted and the rear surface dirt is prevented from forming at a proper timing. Thus, printing quality of the image forming device 25 can be maintained.

Figure 6:
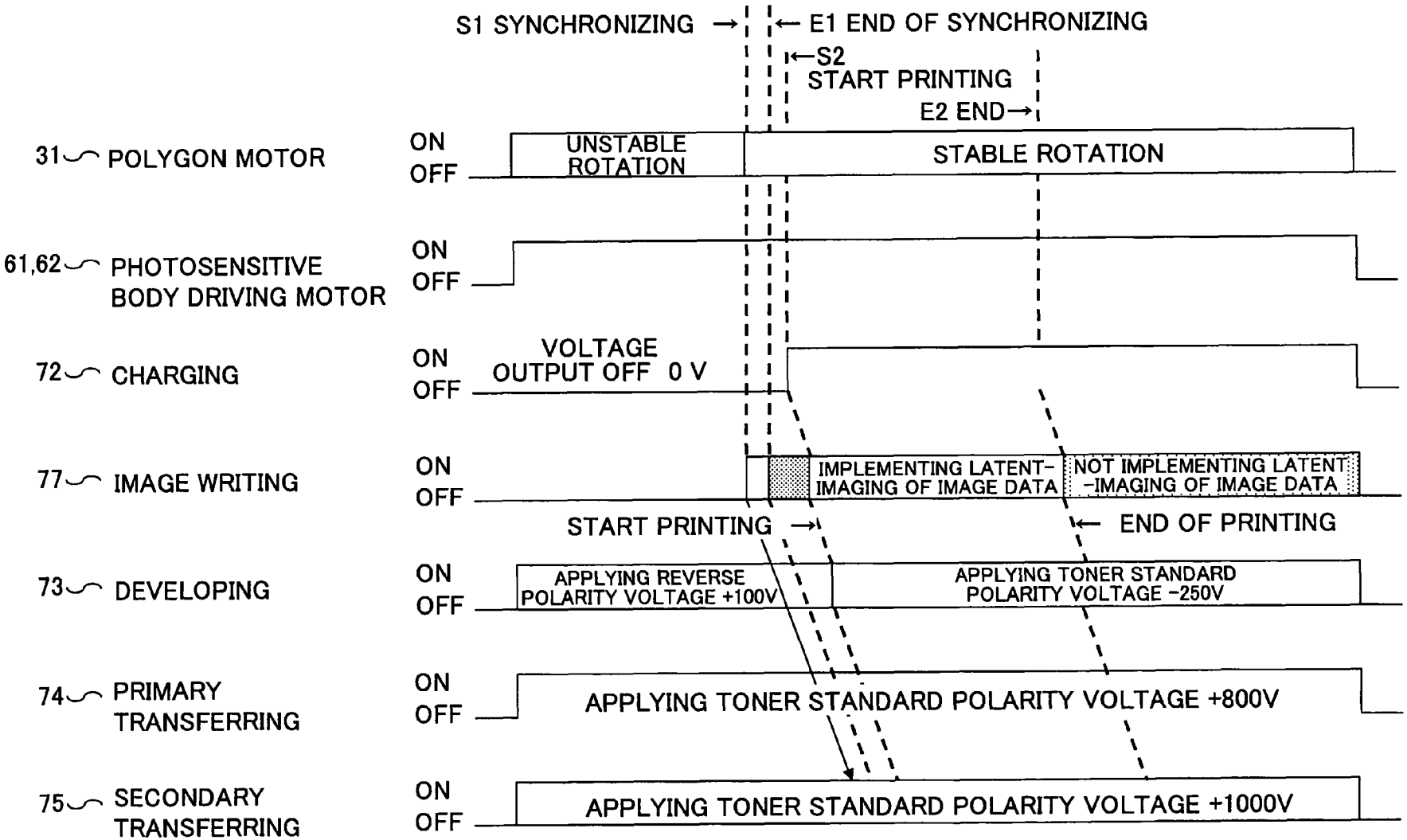
FIG. 6 is a timing chart showing a voltage output in a case of monochrome (black and white) printing of the first embodiment of the present invention.

FIG. 6 is a timing chart showing voltage output in a case of monochrome (black and white) printing of the first embodiment of the present invention.

As shown in the timing chart of FIG. 6, the voltage output control part 76 controls voltages applied to the charging part 72 and the developing part 73.

Here, a method where the voltage output control part 76 controls the voltages applied to the charging part 72 and the developing part 73 so that forming the rear surface dirt is prevented is discussed.

First, when the engine control part 101 of the engine part 100 of the image forming device 25 receives a monochrome (black and white) printing, order, the engine control part 101 starts rotationally driving the polygon mirror 31 at the constant speed and rotational driving of the K photosensitive body driving motor 61 is started.

Next, in order to prevent forming the rear surface dirt due to adjustment of the image forming device position, the engine control part 101 sends the control order to the voltage output control part 76 at the same timing as the start of the rotational driving of the polygon mirror 31 and the K photosensitive body driving motor 61. This order is for controlling the voltages applied to the charging member voltage output part 63 of the charging part 72, the developing member voltage output part 64 of the developing member 73, the primary transferring member voltage output part 65 of the primary transferring member 74, and the secondary transferring member voltage output part 66 of the secondary transferring member 75.

The charging member voltage output part 63 of the charging member 72 turns off (0 V) the voltage of the charging device 10Bk by the voltage output control part 76.

The developing member voltage output part 64 of the developing member 73 applies +100 V that is reverse polarity of the toner standard polarity to the developing device 12Bk by the voltage output control part 76.

The primary transferring member voltage output part 65 of the primary transferring member 74 applies +800 V to the transferring belt 5 by the voltage output control part 76.

The secondary transferring member voltage output part 66 of the secondary transferring member 75 applies +1000 V to the secondary transferring roller 16 by the voltage output control part 76.

Next, after the rotation of the polygon mirror 31 becomes stable, the laser light is irradiated by the image writing part 77. The engine control part 101 orders image writing start by the LD unit 30 for image writing position adjustment, so that the image writing position adjustment is started by the image writing position adjusting part 71.

The rotational speed whereby it is determined whether the rotation of the polygon mirror 31 be stable is determined based on a signal directing a printing mode (including a sheet size, kind of sheets, a color mode, or the like), the signal being simultaneously sent with a printing order signal from the controller part 50.

The transferring member conveying speed of a normal sheet less than 90 g/m$^2$ is 100 through 150 mm/sec and the transferring member conveying speed of a thick sheet equal to or greater than 90 g/m$^2$ is 50 through 75 mm/sec that is a half of that of the normal sheet.

In FIG. 6, "S1" indicates timing when the image writing position adjusting part 71 is started being implemented. "E1" indicates timing when implementing of the image writing position adjusting part 71 is finished. "S2" indicates timing when printing is started after the image writing position adjusting part 71 is implemented. "E2" indicates timing when printing is finished.

Therefore, between "E1" and "S2" of FIG. 6, forming the rear surface dirt after image writing position adjustment is prevented.

Since the voltage output control part 76 is implemented before the image writing position adjustment part 71 is started, namely it is determined that implementing the image writing position adjustment part 71 be necessary, an effect of prevention of forming the rear surface dirt is achieved between "E1" and "S2" of FIG. 6.

Accordingly, between "E1" and "S2" of FIG. 6, an installed timer of the engine control part 101 is used so that the effect of prevention of forming the rear surface dirt continues for a certain time (until "S2" of FIG. 6).

Between "E1" and "S2" of FIG. 6, for the single line image written by the image writing position adjusting part 71 from "S1" to "E1" in FIG. 6, the electric potential of the surface of the photosensitive body 9Bk is almost 0 V by the charging part 72 controlled by the voltage output control part 76, and therefore a latent image is not formed.

In addition to the voltage of 0 V being applied to the surface of the photosensitive body 9Bk by the charging part 72 controlled by the voltage output control part 76, a voltage of +100 V is applied to the developing device 12Bk by the developing part 73 controlled by the voltage output control part 76.

Because of the difference of electric potentials (hereinafter "electric potential gap") between the surfaces of the photosensitive body 9Bk and the developing device 12Bk, the toner having a negative electrical charge potential, namely a standard polarity toner, cannot be adhered on the surface of the photosensitive body 9Bk.

Because of this, it is possible to prevent adhesion of the toner to the photosensitive body 9Bk that is a reason of the rear surface dirt forming due to adjustment of the image writing position, and thereby forming the rear surface dirt can be prevented.

Considering details of the electrical charge polarity of the toner, the voltage value +100 V applied to the developing device 12Bk by the developing part 73 controlled by the voltage output control part 76 is most proper for preventing the rear surface dirt from forming.

There are the standard polarity and a reverse polarity namely a positive electrical charge polarity. Therefore, if the voltage applied to the developing device 12Bk is equal to or greater than +150 V, the electric potential is too large and therefore the reverse polarity toner is adhered.

If the voltage applied to the developing device 12Bk is less than +50 V, the electric potential is too small and therefore the standard polarity toner is adhered.

Thus, it is preferable that the value of the voltage applied to the developing device 12Bk be in a range between +50 V and +150 V.

Since the engine control part 101 implements printing of the image data required by the user after the above-mentioned rear surface dirt prevention process is completed, the following process is implemented by the voltage output control part 76.

Based on the order of the voltage output control part 103, the charging part 72 controlled by the voltage output control part 76 turns on, at the timing of printing start, namely S2 in FIG. 6, the voltage of the charging roller 10Bk that is turned off (0 V) at the time S1 when the image writing position adjustment is started so that the voltage of −1100 V is applied. As a result of this, a charging state (negative charging state) where the latent image can be formed is provided for the image data requested by the user. Hence, the image data requested by the user are formed into a latent image on the surface of the photosensitive body 9Bk by the image writing part 77.

Based on the order of the voltage output control part 103, the developing part 73 controlled by the voltage output control part 76 applies the voltage of −250 V to the developing device 12Bk where the voltage of +100V has been applied.

The latent image formed by the image writing part 77 is developed by the developing part 73 so that the toner image is formed.

In addition, the voltage applied by the primary transferring part 74 and the secondary transferring part controlled by the voltage output control part 76 are the same voltage as the voltage when the image data requested by the user of the image forming device 25 are printed. Therefore, the voltage is not changed and printing is implemented after the rear surface dirt prevention is implemented.

When the color printing request is received, the latent image is formed by the image writing part 77 and developed into the toner image by the developing part 73. The transferring position of the toner image transferred to the transferring belt 5 is matched for each of YMC colors so that a color shift is prevented. Hence, in a state where the AIO cartridge 6Bk corresponding to the color K provided in the image forming device 25 is standard, the voltages are applied by shifting timing by distances of the AIO cartridges 6Y, 6M, and 6C corresponding to the Y, M, and C colors.

The photosensitive body driving motors 61 and 62 are started being driven at the same timing for each of Y, M, Bk, and C colors.

Figure 7:
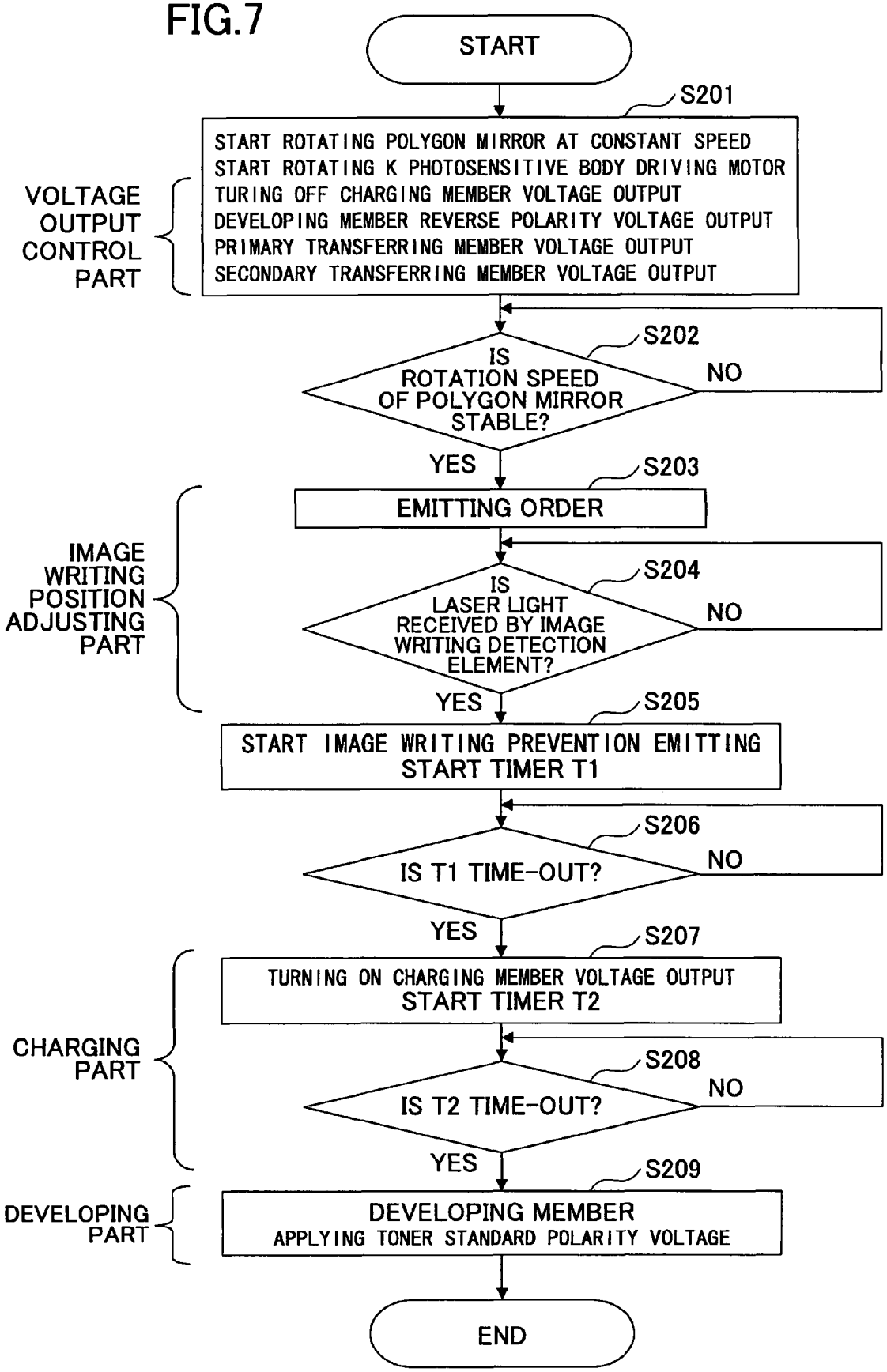
FIG. 7 is a flowchart showing a countermeasure process against the rear surface dirt in the case of the monochrome (black and white) printing of the first embodiment of the present invention.

The process shown in FIG. 5 and the timing chart shown in FIG. 6 are subjects of the following explanation about a flowchart shown in FIG. 7.

FIG. 7 is a flowchart showing a process of countermeasure against the rear surface dirt in the case of the monochrome (black and white) printing of the first embodiment of the present invention.

In addition, the flowchart shown in FIG. 7 corresponds to the rear surface dirt prevention process (S105) shown in FIG. 5 and shows how the process is implemented as a part of the image forming program.

First, the rotational driving of the polygon mirror 31 and the K photosensitive body driving motor 61 is started (S201). At the same timing, the applied voltage is controlled by the voltage output control part 76 as the rear surface dirt prevention process due to the adjustment of the image writing position.

The charging part 72 controlled by the voltage output control part 76 turns off (0 V) the voltage of the charging roller 10Bk (S201).

The developing part 73 controlled by the voltage output control part 76 applies the voltage of +100 V that is the reverse polarity of the toner standard polarity to the developing device 10Bk (S201).

The primary transferring part 74 controlled by the voltage output control part 76 applies the voltage of +800 V to the transferring belt 5 (S201).

The secondary transferring part 75 controlled by the voltage output control part 76 applies the voltage of +1000 V to the secondary transferring roller 16 (S201).

Next, based on the printing mode order from the controller part 50, whether the rotational speed of the polygon motor 31 whose rotational driving is started becomes stable is determined (S202).

If the rotational driving of the polygon motor 31 does not become stable (S202), the process waits until the rotational speed of the polygon mirror 31 becomes stable.

If the rotational driving of the polygon motor 31 becomes stable (YES in S202), the emitting order to the LD unit 30 is sent by the engine control part 101 of the engine part 100 (S203).

Next, for the image writing position adjustment, whether the laser light emitting from the LD unit 30 is received by the image writing detection element 34 is determined (S204).

In a case where the laser light emitting from the LD unit 30 is not received by the image writing detection element 34 (NO in S204), detection effort continues until the laser light being emitted from the LD unit 30 is received by the image writing detection element 34.

In a case where the laser light being emitted from the LD unit 30 is received by the image writing detection element 34 (YES in S204), it is determined that the LD unit 30 normally emits and the rotational position of the polygon mirror 32 is properly situated. Preventing the laser light to emit from the LD unit 30 is started so that the image writing is not performed on the surface of the photosensitive body 9Bk by means other than the image writing of the image data based on the user's request (S205).

At the same time, in order to switch the voltage of the charging roller 10Bk from "off (0 V)" to "on (−1100 V)", operation of the timer counter T1 using an installed timer of the engine control part 101 is started (S205).

Next, whether the timer counter T1 has reached time-out is determined (S206). If the timer counter T1 is not yet at time-out (NO in S206), the process waits until the timer counter T1 is made to count-up for every second in the RAM of the main storage part 102 of the engine part 100 until the time-out.

The time when the T1 has reached time-out, set in advance, is a time when the single line image is written on the surface of the photosensitive body 9Bk at the time of image writing position adjustment, and is stored in nonvolatile memory of the main storage part 102 of the engine part 103.

In addition, in the case where the timer counter T1 is at time-put (YES in S206), the voltage of the charging roller 10Bk that is turned off (0 V) at the time when the image writing position adjustment is started is turned on by the charging device 72 controlled by the voltage output control part 76, so that the voltage of −1100 V is applied (S207).

As a result of this, the surface of the photosensitive body 9Bk becomes charged (negative charging state) so that the latent image can be formed after static elimination by the charging roller 10Bk. At the same time, since the voltage of the developing device 12Bk is switched from +100 V to −250 V, operation of the timer counter T2 using an installed timer of the engine control part 101 is started (S207).

Next, whether the timer counter T2 has reached time-out is determined (S208).

If the timer counter T2 is not yet at time-out (NO in S208), the process waits until the timer counter T2 is made to count-up for every second in the RAM of the main storage part 102 of the engine part 100 until the time-out.

In addition, in the case where the timer counter T2 is at time-out (YES in S208), the voltage of that is +100 V at the time when the image writing position adjustment is started is changed to −250 V by the developing device 73 controlled by the voltage output control part 76, so that the voltage is applied again (S209).

As a result of this, it is possible to implement printing in a proper image writing position in the printing mode without rear surface dirt.

The process of the voltage output control part 76 for preventing forming the rear surface dirt at the time when the order for the color printing is received is implemented for every color of Y, C, and M as well as the process of K color when the monochrome (black and white) printing order is received.

In addition, as discussed with reference to FIG. 6, the latent image is formed by the image writing part 77 and developed into the toner image by the developing part 73. The transferring position of the toner images transferred to the transferring belt 5 are matched (superposed) for each of YMC colors so that a color shift is prevented.

Hence, in a state where the AIO cartridge 6Bk corresponding to the color K provided in the image forming device 25 is standard, the voltages are applied by shifting timing by distances of the AIO cartridges 6Y, 6M, and 6C corresponding to the Y, M, and C colors.

The photosensitive body driving motors 61 and 62 are started being driven at the same timing for each of Y, M, Bk, and C colors.

Thus, according to the first embodiment of the present invention, the voltages applied to the charging rollers 10Y, 10C, 10M, and 10Bk are turned off (0 V) and the voltages applied to the developing devices 12Y, 12C, 12M, and 12Bk are set to be +100 V by the voltage output control part 103 of the engine part 100. By controlling the voltage output, the latent images of the single line image due to the image writing position adjustment are not formed on the photosensitive bodies 9Y, 9C, 9M, and 9Bk. In addition, the toners from the developing devices 12Y, 12C, 12M, and 12Bk are not adhered on the photosensitive bodies 9Y, 9C, 9M, and 9Bk due to the electric potential between the developing devices 12Y, 12C, 12M, and 12Bk and the photosensitive bodies 9Y, 9C, 9M, and 9Bk. Therefore, the toners are not adhered to the transferring belt 5 and the secondary transferring roller 16 based on the contact with the surfaces of the photosensitive bodies 9Y, 9C, 9M, and 9Bk. Therefore, the rear surface of the conveyed transferring member is not made dirty after the image writing position is adjusted.

In addition, the voltages applied to the charging part 72 and the developing part 73 among the charging part 72, the developing part 73, and the transferring parts 74 and 75 are controlled by the engine control part 101 of the engine part 100. Therefore, it is possible to prevent forming the rear surface dirt more effectively than in the conventional art.

Second Embodiment of the Present Invention

In a second embodiment of the present invention, as well as the first embodiment of the present invention, forming the rear surface dirt of the transferring member due to the adjustment of the image writing position is prevented.

In the first embodiment of the present invention, by controlling the voltages applied to the charging part 72 and the developing part 73 shown in FIG. 4 of the image forming device 25 forming the rear surface dirt of the transferring member due to the adjustment of the image writing position is prevented.

In the second embodiment of the present invention, by controlling the voltages applied to the charging part 72, the developing part 73, and the secondary transferring part 75 shown in FIG. 4 of the image forming device, forming the rear surface dirt of the transferring member due to the adjustment of the image writing position is prevented. In the second embodiment of the present invention, a case where the toner having the reverse polarity is increased due to degradation of the nonmagnetic toner of the image forming device is considered.

The difference between the first embodiment of the present invention and the second embodiment of the present invention is only the control of the voltage applied by the secondary transferring part 75 shown in FIG. 4. Hence, there are overlaps with the first embodiment of the present invention in the second embodiment of the present invention.

Accordingly, since the hardware structure of the image forming device of the second embodiment of the present invention has the same structure as that of the first embodiment of the present invention, FIG. 1 is used, parts that are the same as the parts shown in FIG. 1 are given the same reference numerals, and explanation thereof is omitted.

Since the structure of the exposing device of the second embodiment of the present invention has the same structure as that of the first embodiment of the present invention, FIG. 2 is used, parts that are the same as the parts shown in FIG. 2 are given the same reference numerals, and explanation thereof is omitted.

Since the functional structure of the image forming device of the second embodiment of the present invention has the same structure as that of the first embodiment of the present invention, FIG. 3 is used, parts that are the same as the parts shown in FIG. 3 are given the same reference numerals, and explanation thereof is omitted.

Since the structure of the main part of the second embodiment of the present invention has the same structure as that of the first embodiment of the present invention, FIG. 4 is used, parts that are the same as the parts shown in FIG. 4 are given the same reference numerals, and explanation thereof is omitted.

Since the processes from start of receipt of printing instruction to image writing of the second embodiment of the present invention has the same processes as that of the first embodiment of the present invention, FIG. 4 is used, parts that are the same as the parts shown in FIG. 4 are given the same reference numerals, and explanation thereof is omitted.

Figure 8:
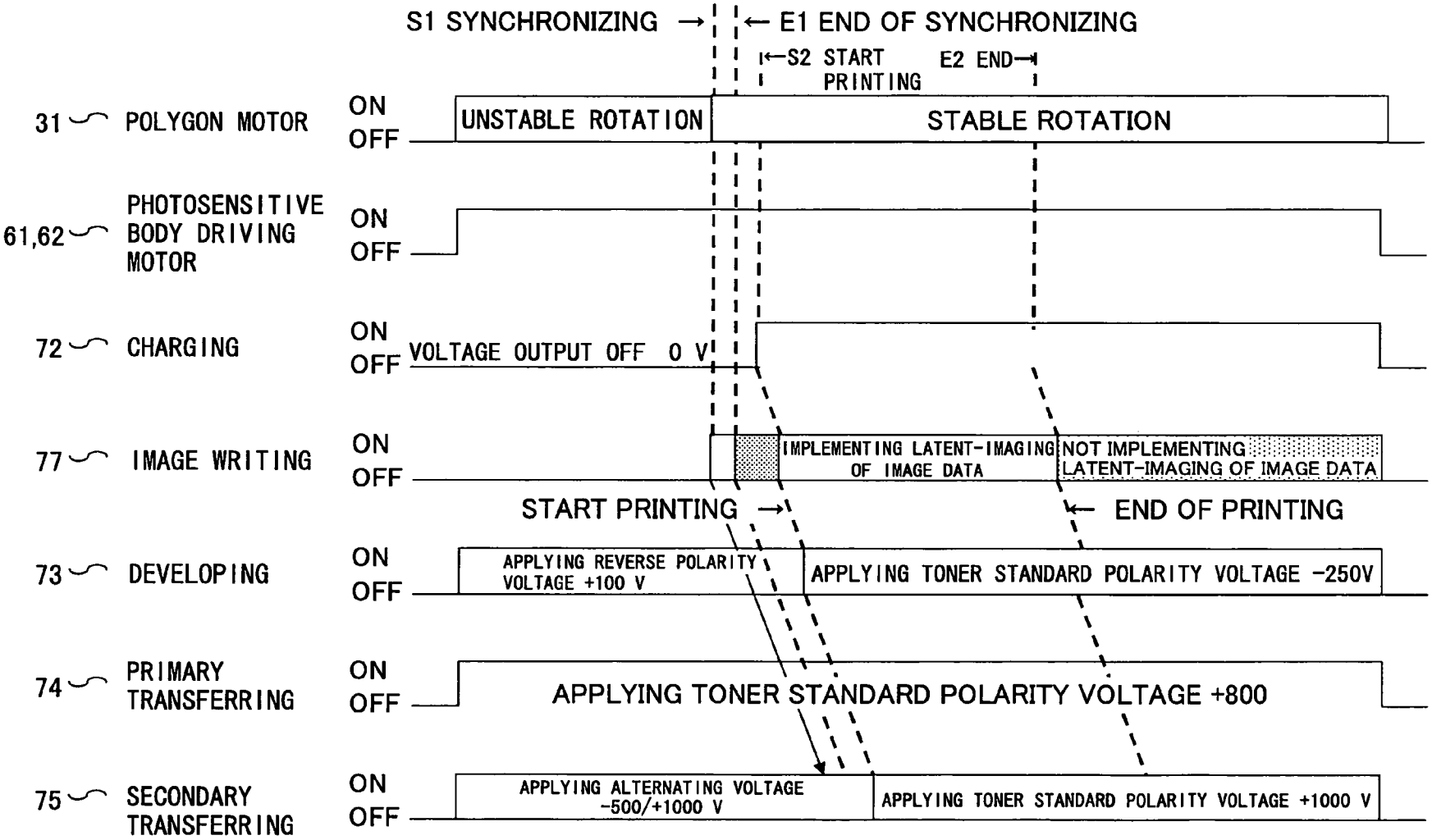
FIG. 8 is a timing chart showing voltage output in a case of monochrome (black and white) printing of the second embodiment of the present invention.

FIG. 8 is a timing chart showing voltage output in a case of monochrome (black and white) printing of the second embodiment of the present invention.

The timing chart of FIG. 8 shows control of the voltages applied to the charging part 72, the developing part 73, and the secondary transferring part 75 by the voltage output control part 76.

In the following, a method is explained wherein the voltage output control part 76 controls the voltages applied to the charging part 72, the developing part 73, and the secondary transferring part 75 so that forming the rear surface dirt is prevented.

First, when the engine control part 101 of the engine part 100 of the image forming device 25 receives a monochrome (black and white printing) order, the engine control part 101 starts rotationally driving the polygon mirror 31 at the constant speed and rotational driving of the K photosensitive body driving motor 61 is started.

Next, in order to prevent forming the rear surface dirt due to adjustment of the image forming device position, the engine control part 101 sends the control order to the voltage output control part 76 at the same timing as the start of the rotational driving of the polygon mirror 31 and the K photosensitive body driving motor 61. This order is for controlling the voltages applied to the charging member voltage output part 63 of the charging part 72, the developing member voltage output part 64 of the developing member 73, the primary transferring member voltage output part 65 of the primary transferring member 74, and the secondary transferring member voltage output part 66 of the secondary transferring member 75.

The charging member voltage output part 63 of the charging member 72 turns off (0 V) the voltage of the charging device 10Bk by the voltage output control part 76.

The developing member voltage output part 64 of the developing member 73 applies +100 V that is reverse polarity of the toner standard polarity to the developing device 12Bk by the voltage output control part 76.

The primary transferring member voltage output part 65 of the primary transferring member 74 applies +800 V to the transferring belt 5 by the voltage output control part 76.

The secondary transferring member voltage output part 66 of the secondary transferring member 75 mutually applies −500 V and +1000 V (alternating voltage) to the secondary transferring roller 16 by the voltage output control part 76.

Next, after the rotation of the polygon mirror 31 becomes stable, the laser light is irradiated by the image writing part 77. The engine control part 101 sends an image writing start order to the LD unit 30 for image writing position adjustment, so that the image writing position adjustment is started by the image writing position adjusting part 71.

Since the rotational speed by which it is determined that the rotation of the polygon motor 31 becomes stable is the same as that of the first embodiment of the present invention, the explanation thereof is omitted.

In FIG. 8, "S1" indicates timing when the image writing position adjusting part 71 is started being implemented. "E1" indicates timing when implementing of the image writing position adjusting part 71 is finished. "S2" indicates timing when printing is started after the image writing position adjusting part 71 is implemented. "E2" indicates timing when printing is finished.

Therefore, between "E1" and "S2" of FIG. 8, forming the rear surface dirt after image writing position adjustment is prevented.

Since the voltage output control part 76 is implemented before the image writing position adjustment part 71 is started being implemented, namely it is determined that implementing the image writing position adjustment part 71 be necessary, an effect of prevention of forming the rear surface dirt is achieved between "E1" and "S2" of FIG. 8.

Accordingly, between "E1" and "S2" of FIG. 8, control is exercised by using an installed timer of the engine control part 101 so that the prevention of the rear surface dirt continues for a certain time (until "S2" of FIG. 8).

Between "E1" and "S2" of FIG. 8, for the single line image written by the image writing position adjusting part 71 from "S1" to "E1" in FIG. 8, since the electric potential of the surface of the photosensitive body 9Bk is almost 0 V set by the charging part 72 controlled by the voltage output control part 76, a latent image is not formed.

In addition, a voltage of 0 V is applied to the surface of the photosensitive body 9Bk by the charging part 72 controlled by the voltage output control part 76. A voltage of +100 V is applied to the developing device 12Bk by the developing part 73 controlled by the voltage output control part 76.

Because of the difference of electric potentials (hereinafter "electric potential gap") between the surfaces of the photosensitive body 9Bk and the developing device 12Bk, the toner having a negative electrical charge potential, namely a standard polarity toner, cannot be adhered on the surface of the photosensitive body 9Bk.

However, there are the standard polarity and a reverse polarity namely a positive electrical charge polarity. Because of degradation due to using or storing the toner, the ratio of the reverse polarity toner included in the entire toner is increase as time passes. Therefore, it is not sufficient to prevent forming the rear surface dirt by using an electric potential gap between the photosensitive body 9Bk and the developing device 12Bk. Therefore, the reverse polarity toner is applied on the surface of the photosensitive body 9Bk.

At this time, by the primary transferring part 74 controlled by the voltage output control part 76, the voltage of +800 V is applied to the transferring belt 5 and an electrical charge having the same polarity as the reverse polarity toner is charged. Hence, it is possible to prevent adhesion of the toner from the photosensitive body 9Bk. However, since the transferring belt 5 comes in contact with the photosensitive body 9Bk, a slight amount of the toner may adhere due to the frictional force at the time of driving. Therefore, this is not sufficient.

Accordingly, by the secondary transferring part 75 controlled by the voltage output control part 76, the alternating voltage of −500 V and +1000 V is applied to the secondary transferring roller 16 whereby the developed toner image is transferred to the transferring member so that forming the rear surface dirt is prevented.

Figure 9:
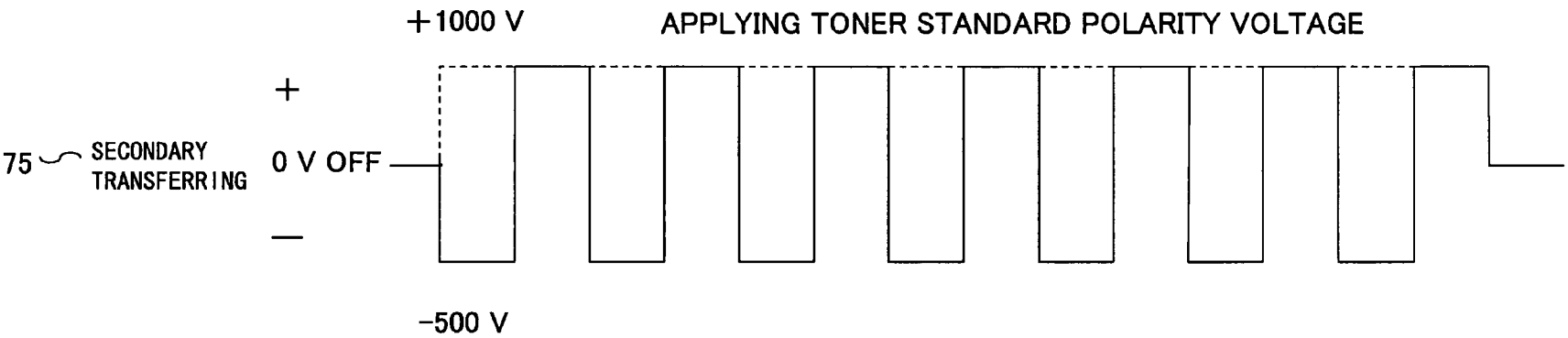
FIG. 9 is a view showing voltage output to a secondary transferring roller 16 of the second embodiment of the present invention.

The alternating voltage applied to the secondary transferring roller 16 by the secondary transferring member 75 controlled by the voltage output control part 76 is shown in FIG. 9.

FIG. 9 is a view showing voltage output to the secondary transferring roller 16 of the second embodiment of the present invention.

The reason why prevention of the rear surface dirt formation is done by the alternating voltage is repeating the positive and negative polarities movement of the alternating voltage.

By the reverse movement of the alternating voltage, the reverse polarity toner is vibrated between the transferring belt 5 and the secondary transferring roller 16, so that the effective prevention of rear surface dirt formation can be achieved.

After implementing the rear surface dirt formation prevention, the engine control part 101 performs printing of the image data requested by the user. Hence, the following processes are implemented by the voltage output control part 76.

Based on the order of the voltage output control part 103, the charging part 72 controlled by the voltage output control part 76 turns on, at the timing of printing start, namely S2 in FIG. 6, the voltage of the charging roller 10Bk that is turned off (0 V) at the time S1 when the image writing position adjustment is started so that the voltage of −1100 V is applied. As a result of this, a charging (negative charging state) where the latent image can be formed is made for the image data requested by the user. Hence, the image data requested by the user forms a latent image on the surface of the photosensitive body 9Bk by the image writing part 77.

Based on the order of the voltage output control part 103, the developing part 73 controlled by the voltage output control part 76 applies the voltage of −250 V to the developing device 12Bk where the voltage of +100V has been applied.

The latent image formed by the image writing part 77 is developed by the developing part 73 so that the toner image is formed.

Based on the order of the voltage output control part 103, the secondary transferring part 75 controlled by the voltage output control part 76 applies the voltage of +1000 V to the secondary transferring roller 16 where the alternating voltage of −500 V and +1000 V has been applied.

In addition, the voltage applied by the primary transferring part 74 controlled by the voltage output control part 76 is the same voltage as the voltage when the image data requested by the user of the image forming device 25 are printed. Therefore, the voltage is not changed and printing is implemented after the rear surface dirt formation prevention is implemented. Since the timing of the voltage output when the color printing is received is the same as that of the first embodiment of the present invention, explanation thereof is omitted.

Figure 10:
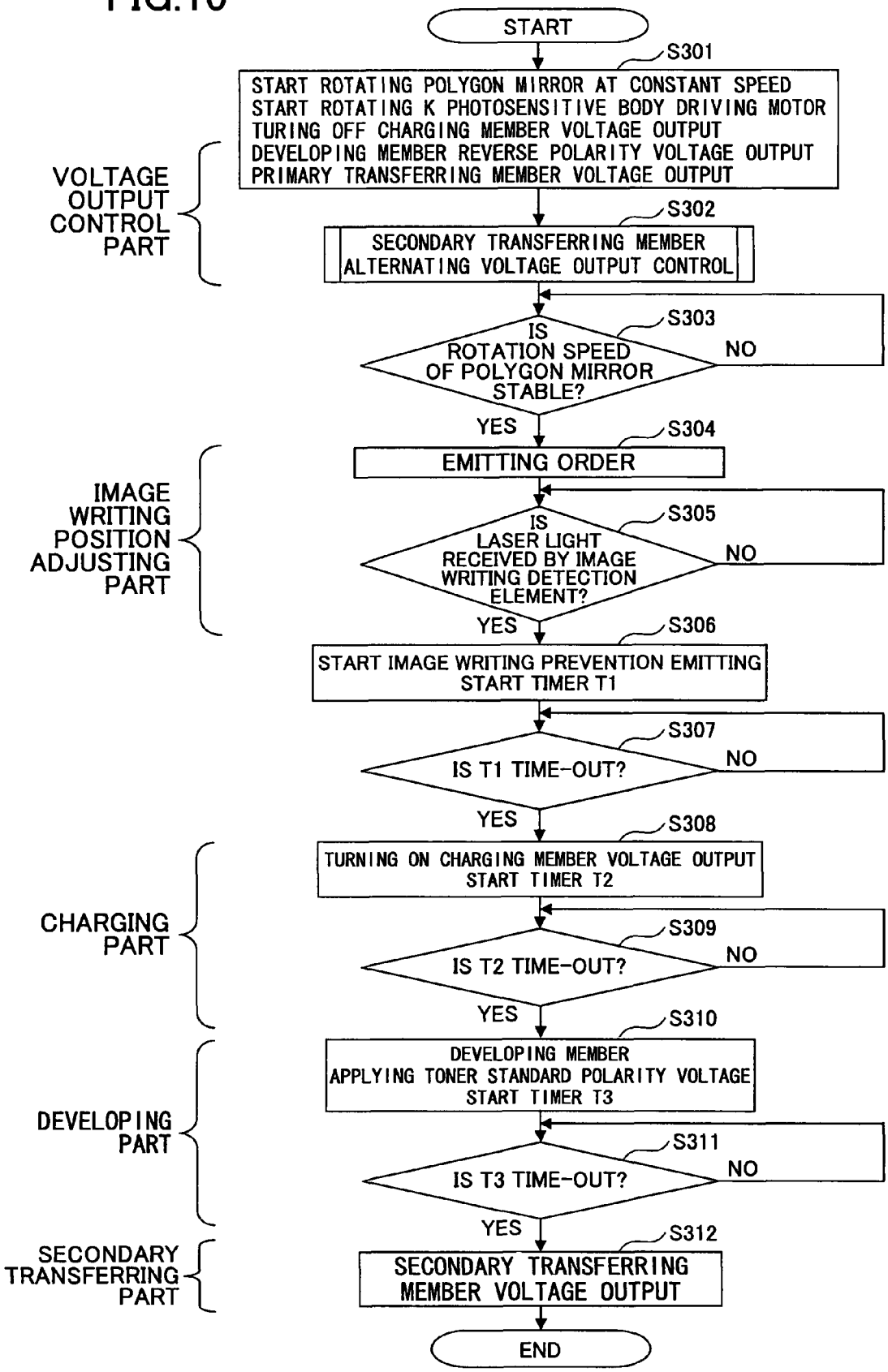
FIG. 10 is a flowchart showing a countermeasure process against the rear surface dirt in the case of the monochrome (black and white) printing of the second embodiment of the present invention.

The process shown in FIG. 5 and the timing chart shown in FIG. 8 are subjects of the following explanation about a flowchart shown in FIG. 10.

FIG. 10 is a timing chart showing a process of countermeasure against the rear surface dirt in the case of the monochrome (black and white) printing of the second embodiment of the present invention.

In addition, the flowchart shown in FIG. 10 corresponds to the rear surface dirt prevention process (S105) shown in FIG. 5 and shows how the process is implemented as a part of the image forming program.

First, the rotational driving of the polygon mirror 31 and the K photosensitive body driving motor 61 are started (S301). At the same timing, the applied voltage is controlled by the voltage output control part 76 as the rear surface dirt forming prevention process due to the adjustment of the image writing position.

The charging part 72 controlled by the voltage output control part 76 turns off (0 V) the voltage of the charging device 10Bk (S301).

The developing part 73 controlled by the voltage output control part 76 applies the voltage of +100 V that is the reverse polarity of the toner standard polarity to the developing device 10Bk (S301).

The primary transferring part 74 controlled by the voltage output control part 76 applies the voltage of +800 V to the transferring belt 5 (S301).

The secondary transferring part 75 controlled by the voltage output control part 76 applies the voltage of +1000 V to the secondary transferring roller 16 (S301).

Next, the secondary transferring part 75 controlled by the voltage output control part 76 applies the alternating voltages of −500 V and +1000 V to the secondary transferring roller 16 (S302).

Next, based on the printing mode order from the controller part 50, whether the rotational speed of the polygon motor 31 whose rotational driving is started becomes stable is determined (S303).

If the rotational driving of the polygon motor 31 does not become stable (NO in S303), the process waits until the rotational speed of the polygon mirror 31 becomes stable.

If the rotational driving of the polygon motor 31 becomes stable (YES in S303), the emitting order to the LD unit 30 is sent by the engine control part 101 of the engine part 100 (S304).

Next, for the image writing position adjustment, whether the laser light emitted from the LD unit 30 is received by the image writing detection element 34 is determined (S305).

In a case where the laser light emitted from the LD unit 30 is not received by the image writing detection element 34 (NO in S305), detection efforts continue until the laser light emitting from the LD unit 30 is received by the image writing detection element 34.

In a case where the laser light emitted from the LD unit 30 is received by the image writing detection element 34 (YES in S305), it is determined that the LD unit 30 normally emits and the rotational position of the polygon mirror 32 is properly situated. Preventing the laser light being emitted from the LD unit 30 is started so that the image writing is not made on the surface of the photosensitive body 9Bk by means other than the image writing of the image data based on the user's request (S306).

At the same time, in order to switch the voltage of the charging roller 10Bk from "off (0 V)" to "on (−1100 V)", operation of the timer counter T1 using an installed timer of the engine control part 101 is started (S306).

Next, whether the timer counter T1 has reached time-out is determined (S307).

If the timer counter T1 is not yet at time-out (NO in S307), the process waits until the timer counter T1 is made to count-up for every second in the RAM of the main storage part 102 of the engine part 100 until the time-out.

The time when the T1 is at time-out, set in advance, is a time when the single line image written on the surface of the photosensitive body 9Bk at the time of image writing position adjustment and is stored in nonvolatile memory of the main storage part 102 of the engine part 103.

In addition, in the case where the timer counter T1 is at time-out (YES in S307), the voltage of the charging device 10Bk that is turned off (0 V) at the time when the image writing position adjustment is started is turned on by the charging device 72 controlled by the voltage output control part 76, so that the voltage of −1100 V is applied (S308).

As a result of this, the surface of the photosensitive body 9Bk becomes charged (negative charging state) where the latent image can be formed after static eliminated by the charging device 10Bk. At the same time, since the voltage of the developing device 12Bk is switched from +100 V to −250 V, operation of the timer counter T2 using an installed timer of the engine control part 101 is started (S308).

Next, whether the timer counter T2 is at time-out is determined (S309).

If the timer counter T2 is not yet at time-out (NO in S309), the process waits until the timer counter T2 is made to count-up every second in the RAM of the main storage part 102 of the engine part 100 until the time-out.

In addition, in the case where the timer counter T2 is at time-out (YES in S309), the voltage that is turned to +100 V at the time when the image writing position adjustment is started is changed to −250 V by the developing device 73 controlled by the voltage output control part 76, so that the voltage is applied again (S310).

At the same time, the alternating voltages of −500 V and +1000 V applied to the secondary transferring roller 16 are switched to the voltage of +1000 B. Therefore, operation of the timer counter T3 using an installed timer of the engine control part 101 is started (S310).

Next, whether the timer counter T3 is at time-out is determined (S311).

If the timer counter T3 is not yet at time-out (NO in S311), the process waits until the timer counter T2 is made to count-up for every second in the RAM of the main storage part 102 of the engine part 100 until the time-out.

In addition, in the case where the timer counter T3 is at time-out (YES in S311), the voltage of that is the alternating voltage of −500 V and +1000 V at the time when the image writing position adjustment is started is changed to +1000 V by the transferring device 75, so that the voltage is applied again (S312).

As a result of this, it is possible to implement printing in a proper image writing position on the printing mode forming rear surface dirt.

The process of the voltage output control part 76 for preventing forming the rear surface dirt at the time when an order for the color printing is received is the same as that of the first embodiment of the present invention. Therefore, the explanation thereof is omitted.

Thus, according to the second embodiment of the present invention, the voltages applied to the charging rollers 10Y, 10C, 10M, and 10Bk are turned off (0 V) and the voltages applied to the developing devices 12Y, 12C, 12M, and 12Bk are set to be +100 V by the voltage output control part 103 of the engine part 100. By controlling the voltage output, the latent images of the single line image due to the image writing position adjustment are not formed on the photosensitive bodies 9Y, 9C, 9M, and 9Bk. In addition, the toners from the developing devices 12Y, 12C, 12M, and 12Bk are not adhered to the photosensitive bodies 9Y, 9C, 9M, and 9Bk due to the electric potential between the developing devices 12Y, 12C, 12M, and 12Bk to the photosensitive bodies 9Y, 9C, 9M, and 9Bk. Therefore, the toners are not adhered to the transferring belt 5 and the secondary transferring roller 16 based on the contact with the surfaces of the photosensitive bodies 9Y, 9C, 9M, and 9Bk. Therefore, the rear surface of the conveyed transferring member is not made dirty after the image writing position is adjusted.

In a case where the reverse polarity toner increased because of degradation due to using or storage of the toner is adhered to the photosensitive body 9Bk and the transferring belt 5 coming in contact with the photosensitive body 9Bk, the alternating voltage of +500 V and −1000 V is applied to the secondary transferring roller 16 by the secondary transferring part 75 in addition to the charging part 72 and the developing part 73, so that the toner is not adhered to the secondary transferring roller 16 and the rear surface of the conveyed transferring member is not made dirty after the image writing position is adjusted.

In addition, the voltages applied to the charging part 72, the developing part 73 and the secondary transferring part 75 among the charging part 72, the developing part 73, and the transferring parts 74 and 75 are controlled by the engine control part 101 of the engine part 100. Therefore, it is possible to prevent forming the rear surface dirt more effectively than in the conventional art.

The present invention is not limited to these embodiments, but variations and modifications may be made without departing from the scope of the present invention.

Thus, according to the above-discussed embodiment of the present invention it is possible to provide an image forming method, including: a charging step of charging an image carrier; an image writing step of writing image data onto the image carrier; a developing step of developing a latent image area written by the image writing step on the image carrier; a transferring step of transferring a toner image developed by the developing step to a transferring member; an image writing position adjusting step of detecting a position of the image carrier where the image is written in a case where designated conditions are satisfied, and of adjusting an image writing position; and a voltage output control step of controlling voltages applied for charging, developing, and transferring in the charging step, the developing step, and the transferring step, respectively; wherein, in a case where the image writing position adjusting step is implemented, outputs of the voltages are controlled in advance by the voltage output control step so that at least two of charging, developing, and transferring are not implemented in the charging step, the developing step, and the transferring step, respectively.

According to the above-mentioned image forming method, it is possible to prevent forming the rear surface dirt due to image writing position adjustment.

The image writing position adjusting step may be implemented at the time of start of printing and at the time of change of a printing condition.

According to the above-mentioned image forming method, it is possible to implement image writing position adjustment at a proper timing without influence on image quality.

Output of the voltage to a charging member may be turned off in the charging step; and a voltage having reverse polarity of a standard polarity of a toner may be output to a developing member in the developing step.

According to the above-mentioned image forming method, it is possible to prevent forming the rear surface dirt due to image writing position adjustment.

A voltage having reverse polarity of a standard polarity of a toner may be output to a developing member in the developing step; and the voltage having the reverse polarity of the standard polarity of the toner and a voltage having the same polarity as the polarity of the standard polarity of the toner may be mutually output to an intermediate transferring member in the transferring step.

According to the above-mentioned image forming method, it is possible to prevent forming the rear surface dirt due to image writing position adjustment.

The transferring step may include a first transferring step and a second transferring step; output of a voltage to the transferring member may be turned off in the first transferring step; and a voltage having reverse polarity of a standard polarity of a toner may be output to the transferring member in the second transferring step.

According to the above-mentioned image forming method, it is possible to prevent forming the rear surface dirt due to image writing position adjustment.

Output of the voltage to a charging member may be turned off in the charging step; a voltage having reverse polarity of a standard polarity of a toner may be output to a developing member in the developing step; and the voltage having the reverse polarity of the standard polarity of the toner and a voltage having the same polarity as the polarity of the standard polarity of the toner may be mutually output to the transferring member in the transferring step.

According to the above-mentioned image forming method, it is possible to prevent forming the rear surface dirt due to image writing position adjustment.

The output of the voltage having the reverse polarity of the standard polarity of the toner in the developing step may be in a range +50 V to +150V.

According to the above-mentioned image forming method, proper electric potential difference is generated between the image carrier and the developing member so that forming the rear surface dirt can be prevented.

Voltages output to the charging member, the developing member, and the transferring member may be started in the charging step, the developing step, and the transferring step, respectively, at the same timing as the timing of driving start of the image carrier.

According to the above-mentioned image forming method, it is possible to prevent forming the rear surface dirt due to image writing position adjustment.

In a case where printing is started or a printing condition is changed, in continuing printing, before image data are written onto the image carrier in the image writing step, voltages output to the charging member, the developing member, and the transferring member may be started in the charging step, the developing step, and the transferring step, respectively.

According to the above-mentioned image forming method, it is possible to prevent forming the rear surface dirt due to image writing position adjustment.

After adjustment of the image writing position is normally finished in the image writing position adjusting step, voltage output to the charging member, the developing member, and the transferring member may be finished in the charging step, the developing step, and the transferring step, respectively.

According to the above-mentioned image forming method, it is possible to prevent forming the rear surface dirt due to image writing position adjustment.

According to the above-discussed embodiment of the present invention, it is possible to provide an image forming device, including: a charging part configured to charge an image carrier; an image writing part configured to write image data onto the image carrier; a developing part configured to develop a latent image area written by the image writing part onto the image carrier; a transferring part configured to transfer a toner image developed by the developing part to a transferring member; an image writing position adjusting part configured to detect a position of the image carrier where the image is written in a case where designated conditions are satisfied, and configured to adjust an image writing position; and a voltage output control part configured to control voltages applied to the charging part, the developing part, and the transferring part; wherein, in a case where the image writing position adjusting part is implemented, outputs of the voltages are controlled in advance by the voltage output control part so that at least two of charging, developing, and transferring are not implemented in the charging part, the developing part, and the transferring part, respectively.

According to the above-mentioned image forming device, it is possible to prevent forming the rear surface dirt due to image writing position adjustment.

The transferring part may include a primary transferring part and a secondary transferring part; output of a voltage to the transferring member may be turned off in the primary transferring part; and a voltage having reverse polarity of a standard polarity of a toner may be output to the transferring member in the secondary transferring part.

According to the above-mentioned image forming device, it is possible to realize miniaturization of the product by simplifying the printing mechanism so that forming the surface dirt due to image writing position adjustment can be prevented.

The developing member may use a nonmagnetic single component method.

According to the above-mentioned image forming device, it is possible to miniaturize the developing member so that the image can be printed with high quality.

According to the above-discussed embodiment of the present invention, it is possible to provide an image forming program making computer implement steps, the steps including: a charging step of charging an image carrier; an image writing step of writing image data onto the image carrier; a developing step of developing a latent image area written by the image writing step on the image carrier; a transferring step of transferring a toner image developed by the developing step to a transferring member; an image writing position adjusting step of detecting a position of the image carrier where the image is written in a case where designated conditions are satisfied, and of adjusting an image writing position; and a voltage output control step of controlling voltages applied for charging, developing, and transferring in the charging step, the developing step, and the transferring step, respectively; wherein, in a case where the image writing position adjusting step is implemented, outputs of the voltages are controlled in advance by the voltage output control step so that at least two of charging, developing, and transferring are not implemented in the charging step, the developing step, and the transferring step, respectively.

According to the above-mentioned image forming program, it is possible to implement each of parts or means of the above-mentioned image forming device by an information processing device.

According to the above-discussed embodiment of the present invention, it is possible to provide a recording medium storing an image forming program, the image forming program making computer implement steps, the steps including: a charging step of charging an image carrier; an image writing step of writing image data onto the image carrier; a developing step of developing a latent image area written by the image writing step on the image carrier; a transferring step of transferring a toner image developed by the developing step to a transferring member; an image writing position adjusting step of detecting a position of the image carrier where the image is written in a case where designated conditions are satisfied, and of adjusting an image writing position; and a voltage output control step of controlling voltages applied for charging, developing, and transferring in the charging step, the developing step, and the transferring step, respectively; wherein, in a case where the image writing position adjusting step is implemented, outputs of the voltages are controlled in advance by the voltage output control step so that at least two of charging, developing, and transferring are not implemented in the charging step, the developing step, and the transferring step, respectively.

The image forming device can read the image forming program from the recoding medium and implement the program.

This patent application is based on Japanese Priority Patent Application No. 2006-38552 filed on Feb. 15, 2006, the entire contents of which are hereby incorporated by reference.

What is claimed is:

1. An image forming method, comprising:

a charging step of charging an image carrier;

an image writing step of writing image data onto the image carrier;

a developing step of developing a latent image area written by the image writing step on the image carrier;

a transferring step of transferring a toner image, developed by the developing step, to a transferring member;

an image writing position adjusting step of detecting a position of the image carrier where an image is written in a case where designated conditions are satisfied, and adjusting an image writing position; and a voltage output control step of applying controlling voltages by a duty ratio of pulse width modulation for charging, developing, and transferring in the charging step, the developing step, and the transferring step, respectively, at a same timing as starting a rotating member of a laser;

controlling outputs of the voltages by the voltage output control step so that at least two of charging, developing, and transferring are implemented elsewhere than in the charging step, the developing step, and the transferring step, respectively, wherein an output of a voltage to a charging member is turned off prior to lighting of the laser and during the charging step, and a voltage having a polarity that is a reverse of a standard polarity of a toner is output to a developing member in the developing step.

2. The image forming method as claimed in claim 1, further comprising:

lighting the laser during the image writing position adjusting step for detection of synchronization for image position adjustment.

3. The image forming method as claimed in claim 1, wherein the voltage having the reverse polarity of the standard polarity of the toner and a voltage having the same polarity as the polarity of the standard polarity of the toner are mutually output to an intermediate transferring member in the transferring step.

4. The image forming method as claimed in claim 1, wherein the voltage having the reverse polarity of the standard polarity of the toner and a voltage having the same polarity as the polarity of the standard polarity of the toner are mutually output to the transferring member in the transferring step.

5. The image forming method as claimed in claim 1, wherein the output of the voltage having the reverse polarity of the standard polarity of the toner in the developing step is in a range +50 V to +150V.

6. The image forming method as claimed in claim 1, wherein voltages output to the charging member, the developing member, and the transferring member are started in the charging step, the developing step, and the transferring step, respectively, at the same timing as the timing of driving start of the image carrier.

7. The image forming method as claimed in claim 1, wherein in a case where printing is started or a printing condition is changed, in continuing printing, before image data are written onto the image carrier in the image writing step, voltages output to the charging member, the developing member, and the transferring member are started in the charging step, the developing step, and the transferring step, respectively.

8. The image forming method as claimed in claim 1, wherein, after adjustment of the image writing position is normally finished in the image writing position adjusting step, voltage output to the charging member, the developing member, and the transferring member are finished in the charging step, the developing step, and the transferring step, respectively.

9. The image forming method as claimed in claim 1, wherein the image writing position adjusting step is performed before the image writing step.

10. The image forming method as claimed in claim 1, further comprising:

lighting the laser during the image writing position adjusting step, wherein throughout the lighting of the laser in the image writing position adjusting step, the output of the voltage to the charging member is turned off and the voltage having the polarity that is the reverse of the standard polarity of the toner is supplied to the developing member.

11. An image forming device, comprising:

a charging part configured to perform charging operation to charge an image carrier;

an image writing part configured to write image data onto the image carrier;

a developing part configured to perform developing operation to develop a latent image area written by the image writing part onto the image carrier;

a transferring part configured to transfer a toner image developed by the developing part to a transferring member;

an image writing position adjusting part configured to detect a position of the image carrier where an image is written in a case where designated conditions are satisfied, and configured to adjust an image writing position; and a voltage output control part configured to apply control voltages by a duty ratio of pulse width modulation to the charging part, the developing part, and the transferring part at a same timing as starting a rotating member of a laser;

wherein, in a case where the image writing position adjusting part is implemented, outputs of the voltages are controlled by the voltage output control part so that at least two of charging, developing, and transferring are implemented elsewhere than in the charging part, the developing part, and the transferring part, respectively, an output of a voltage to the charging part is turned off prior to lighting of the laser and during the charging operation, and a voltage having a polarity that is a reverse of a standard polarity of a toner is output to the developing part during the developing operation.

12. The image forming device, as claimed in claim 11, wherein the developing part uses a nonmagnetic single component method.

13. An image forming program performing computer-implemented steps, the steps comprising:

a charging step of charging an image carrier;

an image writing step of writing image data onto the image carrier;

a developing step of developing a latent image area written by the image writing step on the image carrier;

a transferring step of transferring a toner image developed by the developing step to a transferring member;

an image writing position adjusting step of detecting a position of the image carrier where an image is written in a case where designated conditions are satisfied, and of adjusting an image writing position; and a voltage output control step of applying controlling voltages by a duty ratio of pulse width modulation for charging, developing, and transferring in the charging step, the developing step, and the transferring step, respectively, at a same timing as starting a rotating member of a laser;

controlling outputs of the voltages by the voltage output control step so that at least two of charging, developing, and transferring are implemented elsewhere than in the charging step, the developing step, and the transferring step, respectively, wherein an output of a voltage to a charging member is turned off prior to lighting of the laser and during the charging step, and a voltage having a polarity that is a reverse of a standard polarity of a toner is output to a developing member in the developing step.

14. An image forming method comprising:

a charging step of charging an image carrier;

an image writing step of writing image data onto the image carrier;

a developing step of developing a latent image area written by the image writing step on the image carrier;

a transferring step of transferring a toner image, developed by the developing step, to a transferring member;

an image writing position adjusting step of detecting a position of the image carrier where an image is written in a case where designated conditions are satisfied, and adjusting an image writing position; and a voltage output control step of applying controlling voltages by a duty ratio of pulse width modulation for charging, developing, and transferring in the charging step, the developing step, and the transferring step, respectively, at a same timing as starting a rotating member of a laser;

wherein the image writing position adjusting step further includes turning off a voltage output to a charging member prior to turning on the laser, and applying a voltage having a reverse polarity as compared to a standard polarity of a toner to a developing member.

* * * * *